US005279094A

United States Patent [19]

Odom et al.

[11] Patent Number: 5,279,094

[45] Date of Patent: Jan. 18, 1994

[54] APPARATUS FOR CLOSING BAGS

[75] Inventors: Robert E. Odom, Blaine; Roger A. Field, Andover, both of Minn.

[73] Assignee: Bemis Company, Inc., Minneapolis, Minn.

[21] Appl. No.: 909,968

[22] Filed: Jul. 7, 1992

Related U.S. Application Data

[63] Continuation of Ser. No. 710,108, Jun. 4, 1991, abandoned.

[51] Int. Cl.[5] ..... B65B 51/06

[52] U.S. Cl. ..... 53/139.1; 53/170; 53/370.6; 53/583

[58] Field of Search ..... 29/235, 426.1, 426.5; 53/170, 138.3, 138.7, 138.8, 139.1, 138.4, 284.7, 370.5, 370.6, 371.5, 371.6, 372.4, 417, 480, 481, 583

[56] References Cited

U.S. PATENT DOCUMENTS

| | | | |
|---|---|---|---|
| 1,469,083 | 9/1923 | Harding et al. | 53/138.7 |
| 2,206,761 | 7/1940 | Bergstein | 53/170 |
| 2,911,778 | 11/1959 | Ozor | 53/481 X |
| 3,783,585 | 1/1974 | Hoyland | 53/583 |
| 3,805,489 | 4/1974 | Lieder et al. | 53/3724 X |
| 3,990,216 | 11/1976 | Martin | 53/138.8 |
| 4,554,776 | 11/1985 | Chikitani | 53/583 X |
| 4,813,207 | 3/1989 | Rundle | 53/583 X |
| 4,827,693 | 5/1989 | Egea et al. | 53/429 X |
| 4,912,913 | 4/1990 | Rundle | 53/583 |

*Primary Examiner*—John Sipos
*Assistant Examiner*—Linda B. Johnson
*Attorney, Agent, or Firm*—Senniger, Powers, Leavitt & Roedel

[57] ABSTRACT

A method of and apparatus for uncuffing a bag in a case, forming the top of the bag into a neck, and taping the neck, operable on non-square rectangular cases as well as square cases of different sizes.

14 Claims, 24 Drawing Sheets

-6 +5
INPUTS
1PB START
2PB STOP
3PB STOP
3PE
4PE
5PE
6PE
7PE
8PA
9PA
11PE
12PE
13PE
14PE
15PE
C
1
2
3
4
5
6
7
8
9
10
C
101
102
103
104
105
106
107
108
109
110
299
INFEED GATE
UNCUFFING GATE
TAPING GATE
TRANSFER HD RET
TRANSFER HD EXT
LOW TAPE AMP
KNIFE JAM AMP
FORMING HD UP
FORMING HD ON
UNCUFFING EYE
MAJOR FLAP EYE
MAJOR FLAP EYE
26
27
28
29
30
31
32
33
34
35
36
37
38
39
40
41
42
43
44
45
46
47
48
49
50

APPARATUS FOR CLOSING BAGS

This is a continuation of application Ser. No. 07/710,108, filed Jun. 4, 1991, now abandoned.

BACKGROUND OF THE INVENTION

This invention relates to a method of and apparatus for closing bags, more particularly to a method of and apparatus for closing the tops of open-mouth bags packed in boxes or cases.

The invention is especially directed to a method of and apparatus for closing the tops of bags serving as liners in rectangular boxes or cases which have top closure flaps hinged to the four sides, the top portion of the bag in the case being turned inside out (everted) and cuffed down on the outside of the flaps, the bag or liner having been filled with product and the flaps extending tip at the four sides. The method involves uncuffing the bag, i.e. turning its cuffed top portion outside in so that it extends upwardly from the case, gathering the upwardly extending top portion, and then closing the latter, as by taping, the apparatus being operable to carry out the method, and the method and apparatus involving improvements on the method and apparatus shown in U.S. Pat. Nos. 4,813,207 and 4,912,913.

The method and apparatus shown in said U.S. patents are generally limited to handling square cases, and a principal object of the present invention is to provide an improved method and apparatus capable of handling rectangular cases other than square cases, i.e. cases having four sides, two opposite sides of which are shorter than the other two, the shorter sides being referred to as the ends of the case, and for handling cases of different sizes. Generally, the cases have what are referred to as major closure flaps hinged to the upper edges of the two sides (the long sides) of the case, and what are referred to as minor closure flaps hinged to the upper edges of the ends of the case, these flaps being closed down on top of the case after the bag or liner therein has had its top formed into a neck and the neck closed, as by taping it, and the neck tucked down into the case.

In general, the method of this invention involves closing the top of a bag containing product in a rectangular case having two opposite sides and two opposite ends and side closure flaps and end closure flaps hinged to the top of the sides and ends, respectively, the flaps extending up at the sides and ends, the top of the bag being turned down inside out on the outside of the f laps forming a cuff. The method comprises conveying cases with the bags therein in a predetermined path one after another to an uncuffing station and holding each case at said station, uncuffing the bag and disposing the top of the bag to extend upward above the closure flaps with the top having portions extending up at the sides of the case and portions extending up at the ends of the case, and with the bag mouth open, and bringing the side portions of the top together to flatten the top generally in a vertical plane lying generally centrally between the sides of the case. The case is then conveyed farther forward in said path with the flattened top portion moving forward endwise generally in said plane, the flattened top portion is compacted endwise to form it into a neck for the bag, and a closure is applied to the neck to hold it compacted.

In general, apparatus of this invention comprises means for conveying cases with the bags therein in a predetermined path one after another to an uncuffing station and holding each case at said station, means at said uncuffing station for uncuffing the bag and disposing the top of the bag to extend upward above the closure flaps with the top having portions extending up at the sides of the case and portions extending up at the ends of the case, and with the bag mouth open, and means for bringing the side portions of the top together to flatten the top generally in a vertical plane lying generally centrally between the sides of the case. The conveyor is then operable to convey the case farther forward in said path with the flattened top portion moving forward endwise generally in said plane. The apparatus further comprises means for compacting said flattened top portion endwise to form it into a neck for the bag; and means for applying a closure to the neck to hold it closed.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 1:
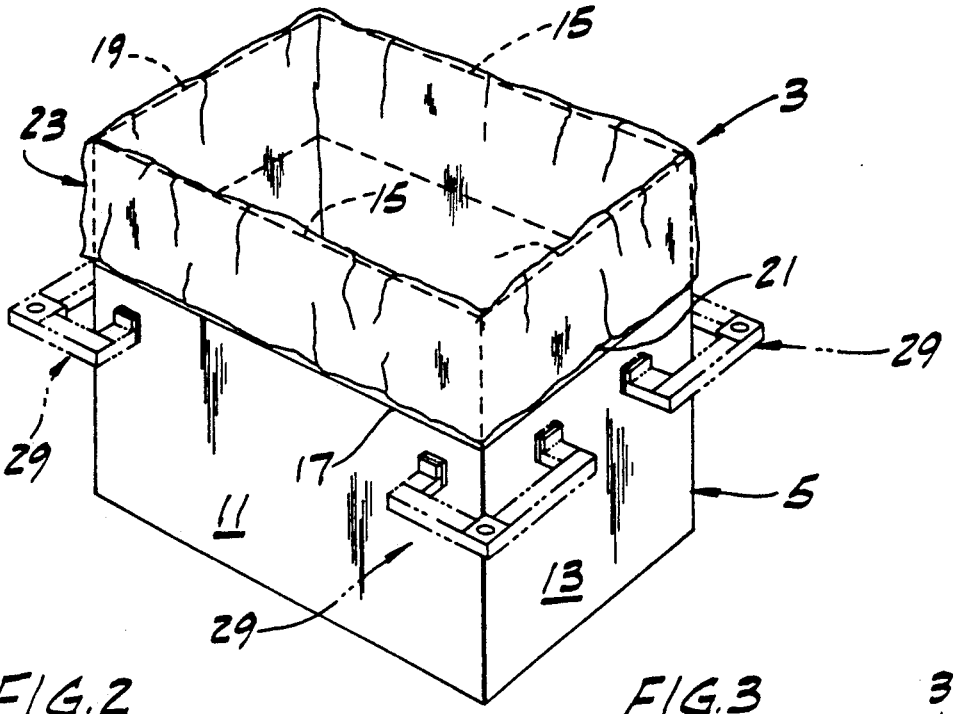
FIG. 1 is a perspective of a case with a bag therein, the bag being cuffed, and snowing in phantom certain uncuffing fingers in their position contacting the sides and ends of the case below the lower edge of the cuff for being moved up to uncuff the bag.

Referring to the drawings, first more particularly to FIGS. 1-10, apparatus of this invention, indicated in its entirety by the reference numeral 1, is shown to be operable to close open-mouth bags such as indicated at 3 which are placed in cases such as indicated at 5, the bags serving as liners in the cases and containing product such as indicated at 7. The case may be a typical rectangular boxboard case having a bottom 9, two opposite sides each designated 11 and two opposite ends each designated 13, the length of the sides 11 being greater than I.-.he width of the ends. Two so-called major or side closure flaps each designated 15 are integrally hinged at 17 to the top of the sides, and two so-called minor or end closure flaps each designated 19 are integrally hinged at 21 to the top of the ends. The bag is a typical open-mouth bag, generally one made of flexible sheet plastic material (e.g. plastic film). As supplied to apparatus 1 of this invention, the case is open with its side flaps 15 and end flaps 19 extending generally vertically upward from the sides and ends of the case. The bag 3, as originally placed in the case, has a height substantially greater than the height of the upper edges of the flaps when upright, and the top portion of the bag, indicated at 23, is turned inside out (everted) and cuffed down on the outside of the upstanding flaps. As illustrated in FIG. 1 the cuffed top portion or cuff 23 extends down about to the flap hinge lines.

Generally, in accordance with this invention, the case 5, with the filled bag or liner 3 therein, with the flaps 15 and 19 extending upward, and with the top portion 23 of the bag cuffed down on the outside of the flaps, is positioned by means of a belt conveyor 25 at an uncuffing station S1. Here the bag is uncuffed by uncuffing means indicated generally at 27, this means comprising four sets of uncuffing fingers, each set being designated 29 and each comprising a pair of uncuffing fingers 31 and 33 extending at right angles to one another from a hub 34, the fingers having an upwardly extending fingertip 31*t*, 33*t*. The four sets of fingers are swingable inwardly from a retracted position (see FIG. 18) at the sides of the apparatus, permitting a case 5 to be conveyed into position at station S1 for the uncuffing operation, to an operative position (see FIG. 19) wherein one finger of each set extends on the outside of a respective side of the case and the other on the outside of a respective end of the case straddling a respective one of the four vertical corners of the case below the lower edge of the cuff 23. The swing of the fingers from their outer retracted position to their inner operative position occurs with all four sets of fingers in the lowered position of FIG. 8. Then, for uncuffing, the four sets of fingers are raised and the finger tips 31*t*, 33*t* move upward underneath the cuff 23, acting to turn it back outside in and causing it to extend up above the case closure flaps 15, 19 with the uncuffed top portion 23 of the bag having generally rectangular portions 23*a* and 23*b* extending generally vertically upward at the ends of the case and generally rectangular portions 23*c* extending generally vertically upward at the sides of the case.

As will be described, the four sets 29 of uncuffing fingers are not only movable in and out between their retracted and swung-in operative positions, and movable up and down between the lowered position in which they appear in solid lines in FIG. 8 and the raised position in which they appear in phantom in FIG. 8, but are also adjustable longitudinally and laterally with respect to the apparatus for operation on cases of different lengths and widths.

Figure 2:
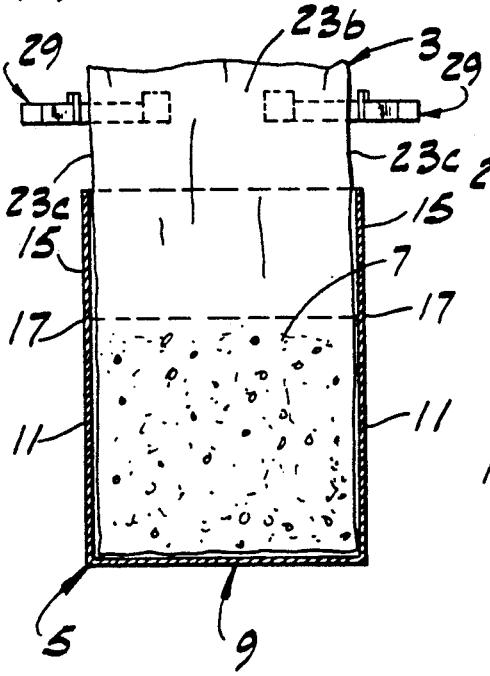
FIGS. 2 and 3 are views in transverse section and longitudinal section of the case and bag showing the uncuffing fingers raised from their FIG. 1 position and the bag uncuffed.
Figure 3:
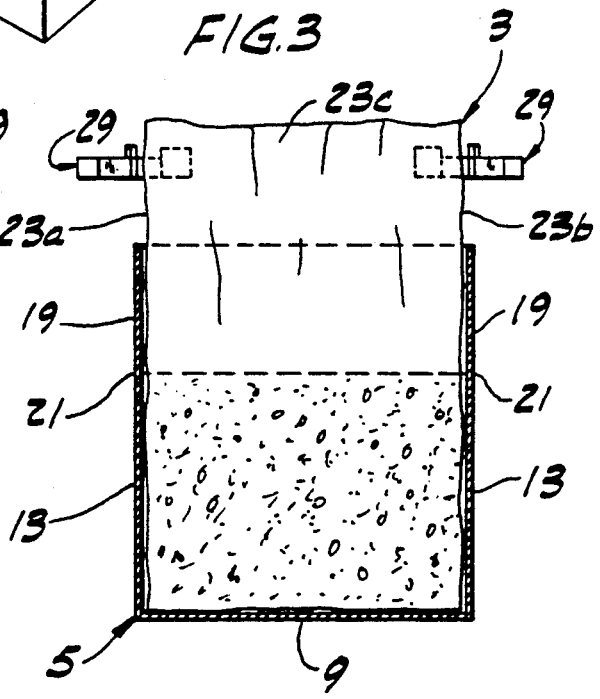
Figure 4:
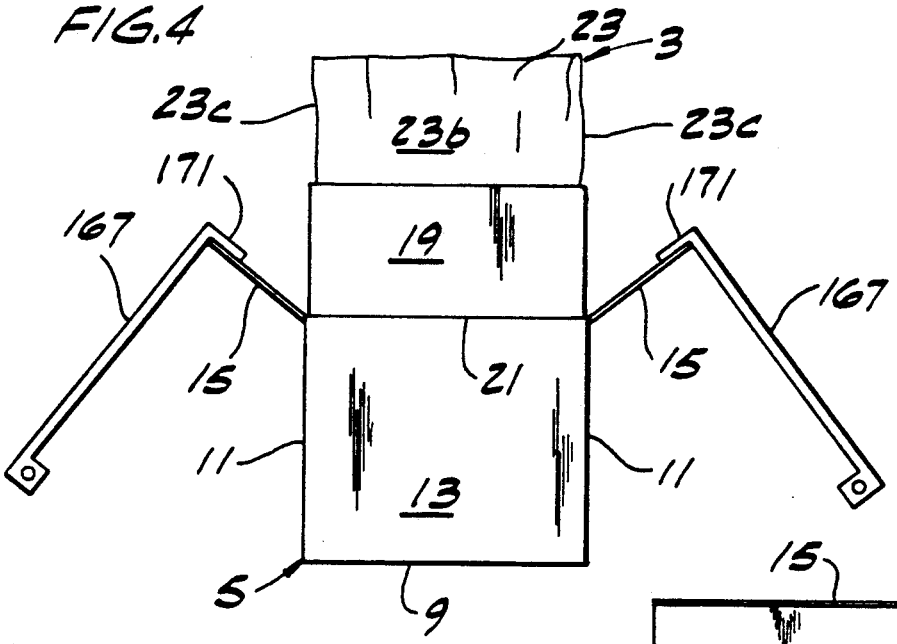
FIG. 4 is an end view of the case and uncuffed bag showing the major flaps of the case pulled down.

When the bag in the case at the uncuffing station S1 has been uncuffed, i.e., when the top portion 23 of the bag has been brought to its raised four-sided conformation of FIGS. 2-4, opposite sides 23*c* of the top portion are brought together to flatten the top portion generally in a vertical plane P (see FIG. 6) extending endwise of the case generally centrally between the sides of the case. Means for so flattening the top portion of the bag is indicated generally at 35. As illustrated, this means generally comprises means 37 for intucking or gusseting the portions 23*a* and 23*b* of the uncuffed top portion, and bag clamps 39 which move in from a retracted position at the sides of the apparatus for pressing the side portions 23*c* of the uncuffed top portion together to flatten them with the intucks or gussets, indicated at 41 in FIGS. 5 and 6, between them. The resultant flattened top portion of the bag is indicated at 43. It extends in the central vertical longitudinal plane of the conveyor 21.

Following the flattening of the top portion of the bag, the bag is released from the uncuffing station S1 for being transported farther forward by the conveyor 25 to a bag top closure means indicated generally at 45. The bag top flattening means 35 moves forward generally in unison with the conveyor, holding the bag top 43 in its flattened condition for the ensuing closing operation.

Figure 8:
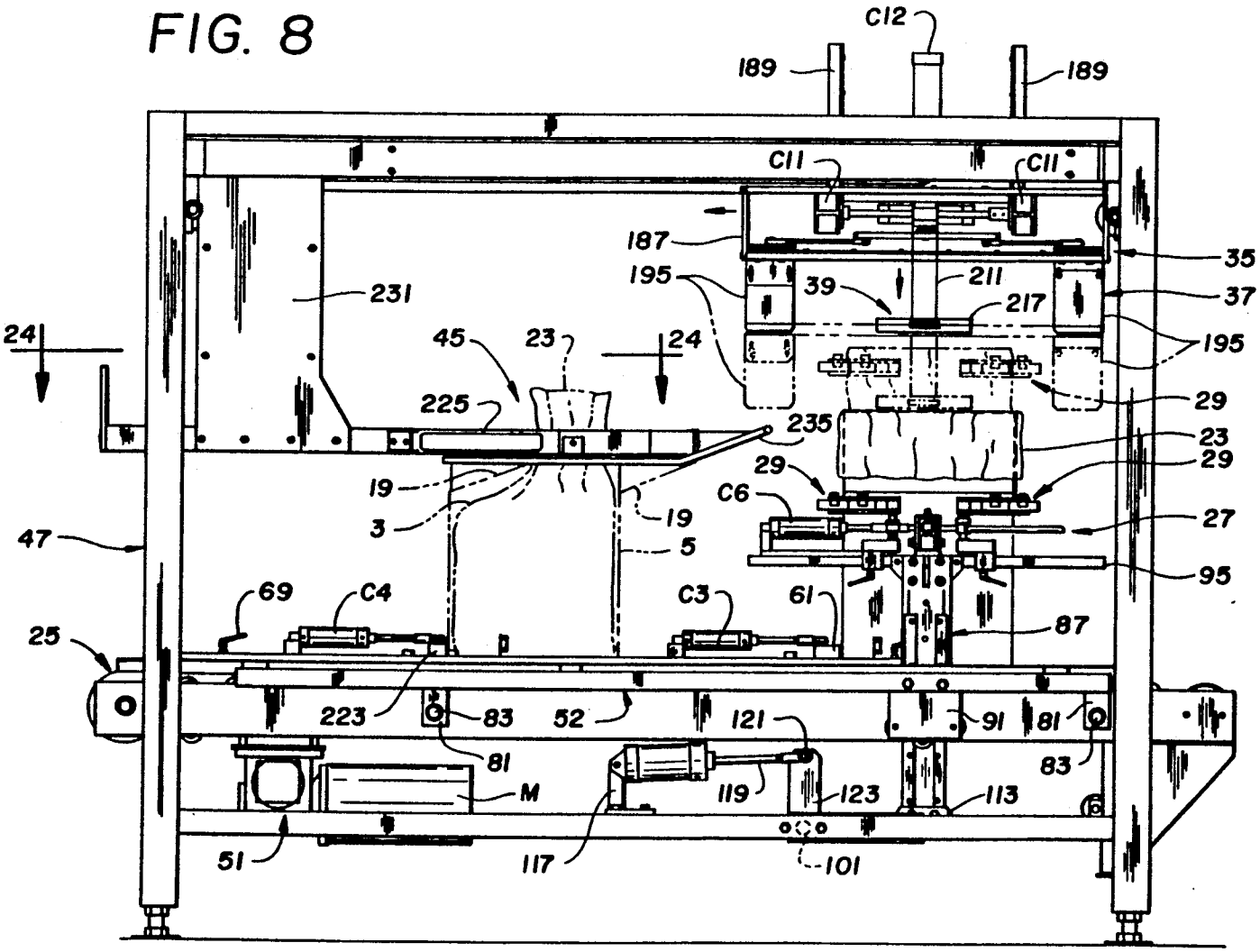
FIG. 8 is a side elevation of the apparatus of this invention.
Figure 9:
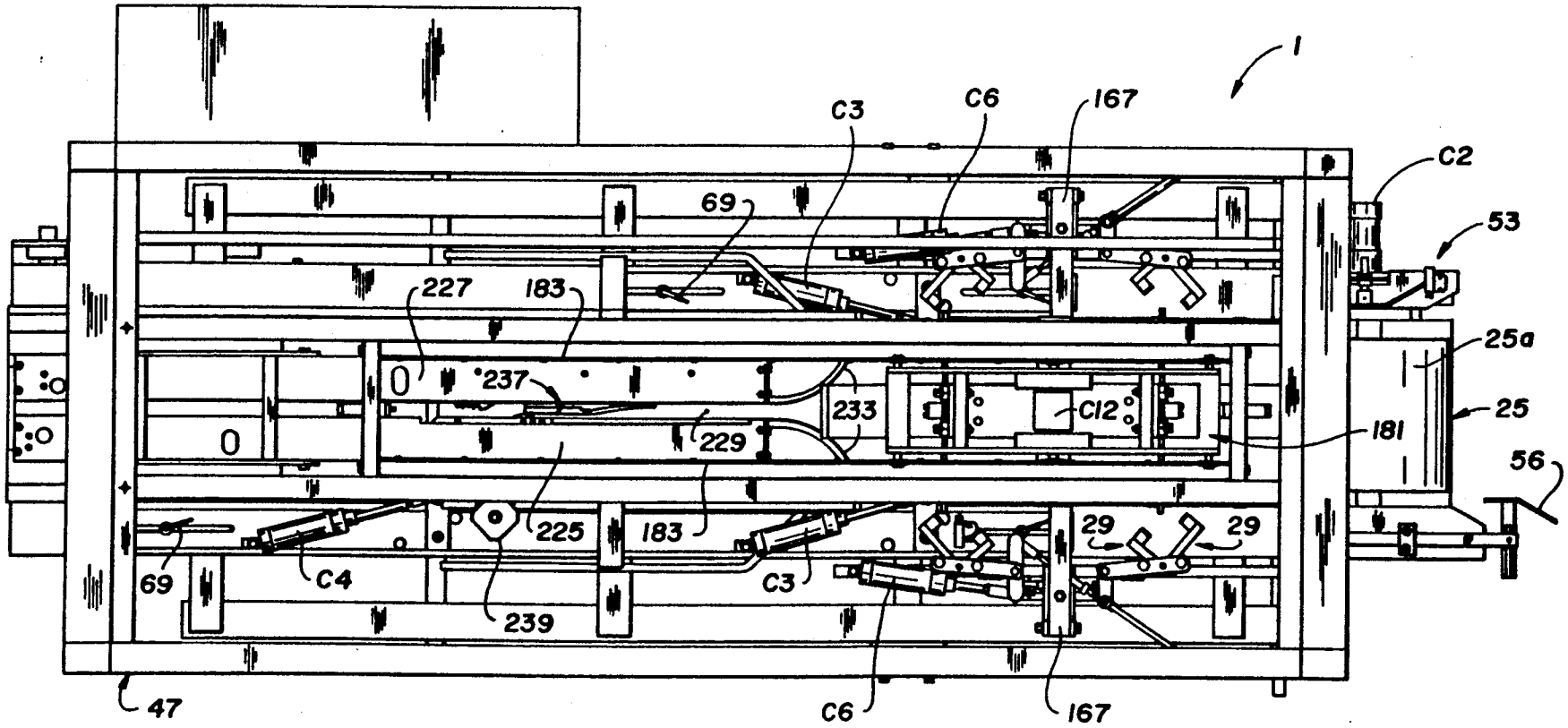
FIG. 9 is a plan of the apparatus.
Figure 10:
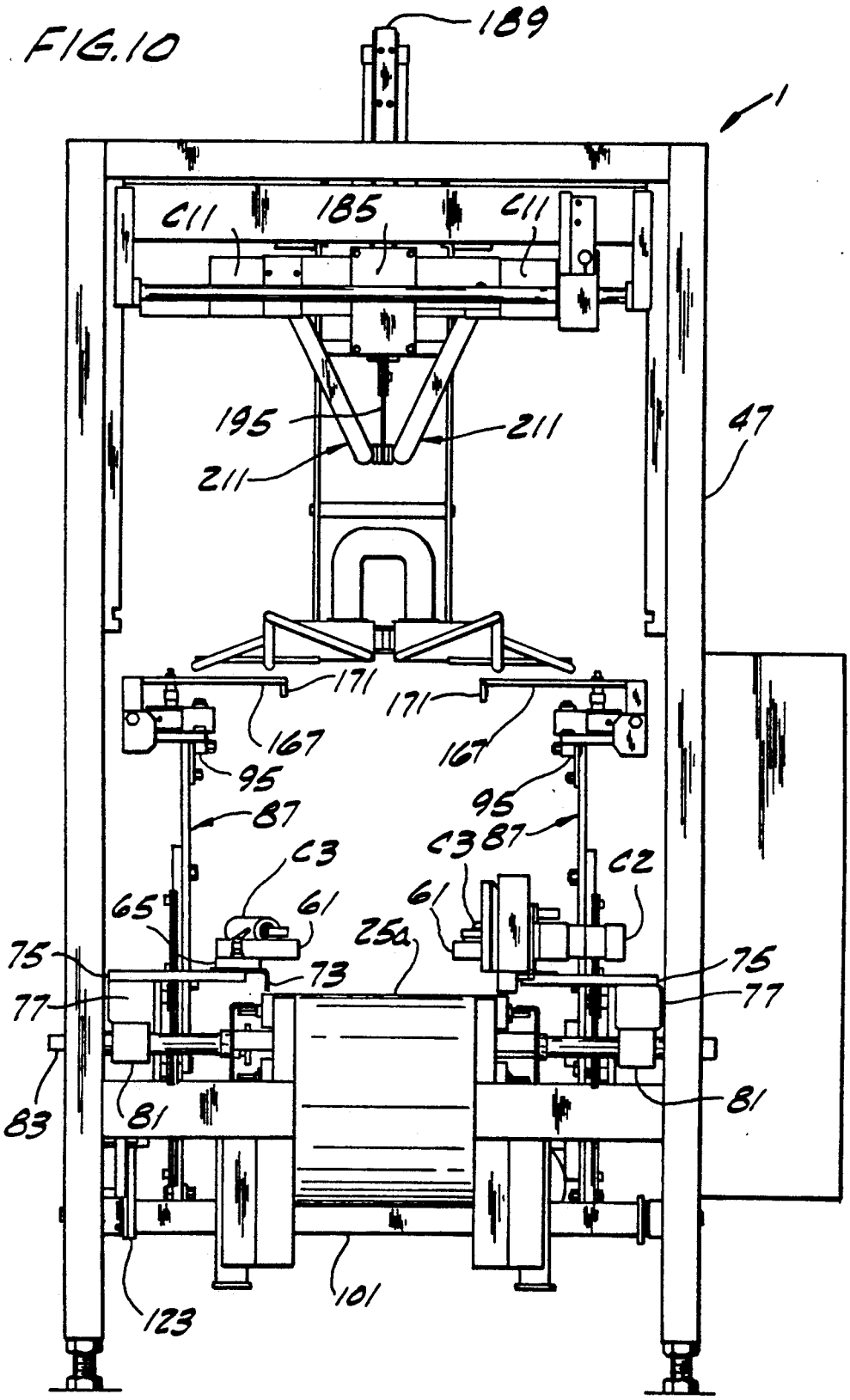
FIG. 10 is an end elevation of the apparatus as viewed from its rear or entrance end (its right end as viewed in FIGS. 8 and 9)
Figure 11:
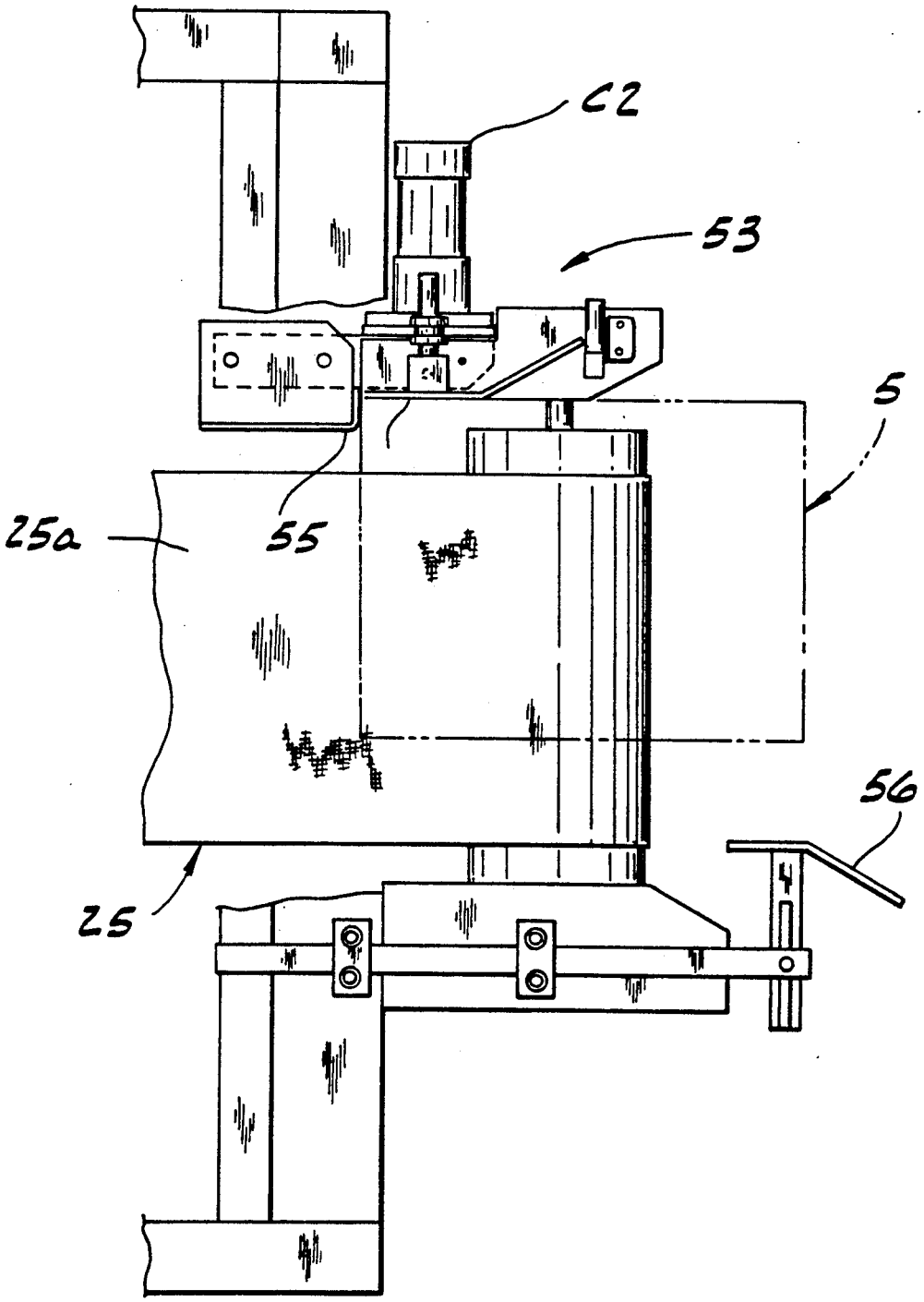
FIG. 11 is an enlarged fragment of FIG. 9 with parts broken away, showing a case indexing mechanism.
Figure 12:
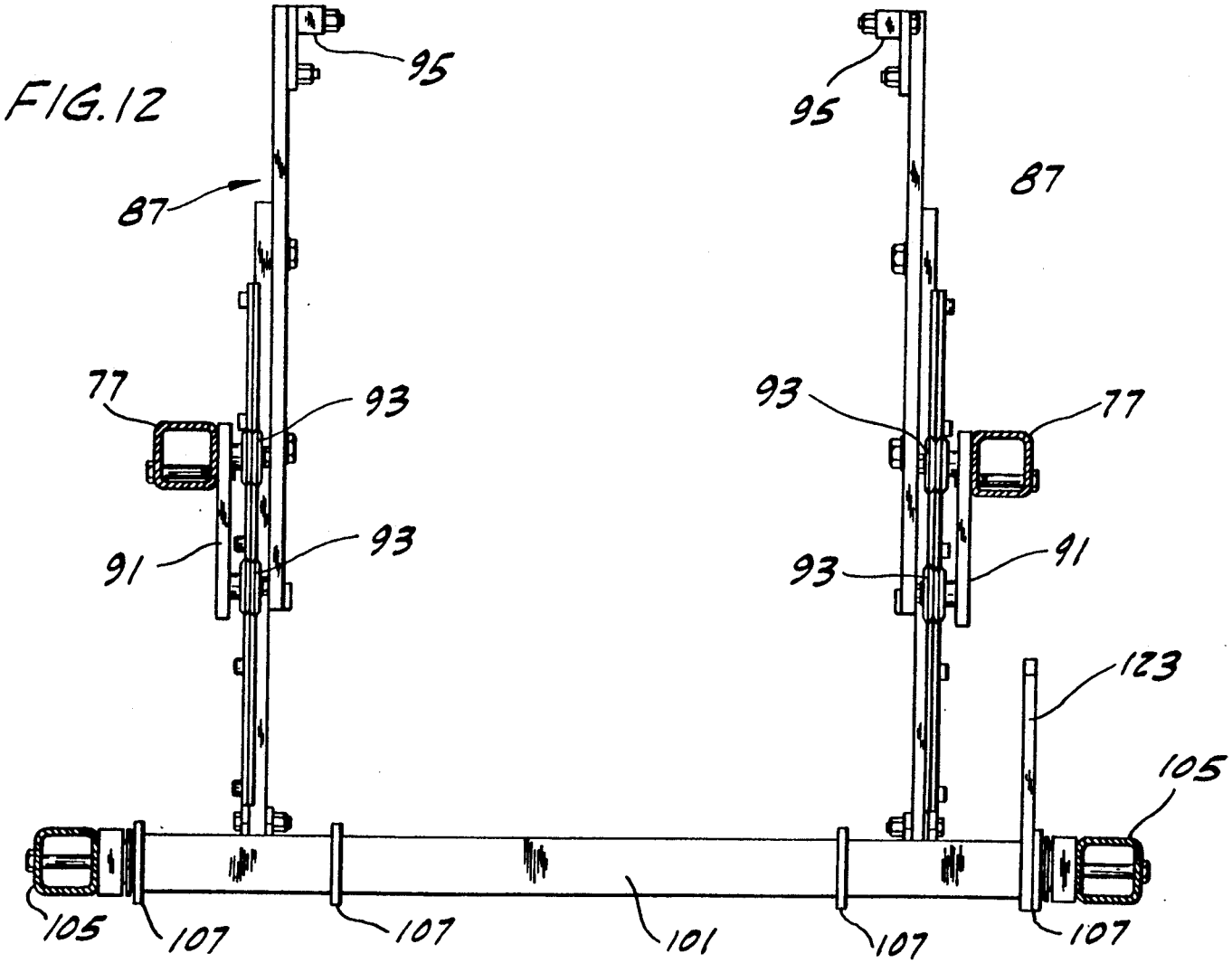
FIG. 12 is an enlarged vertical section generally on line 12—12 of FIG. 8.
Figure 13:
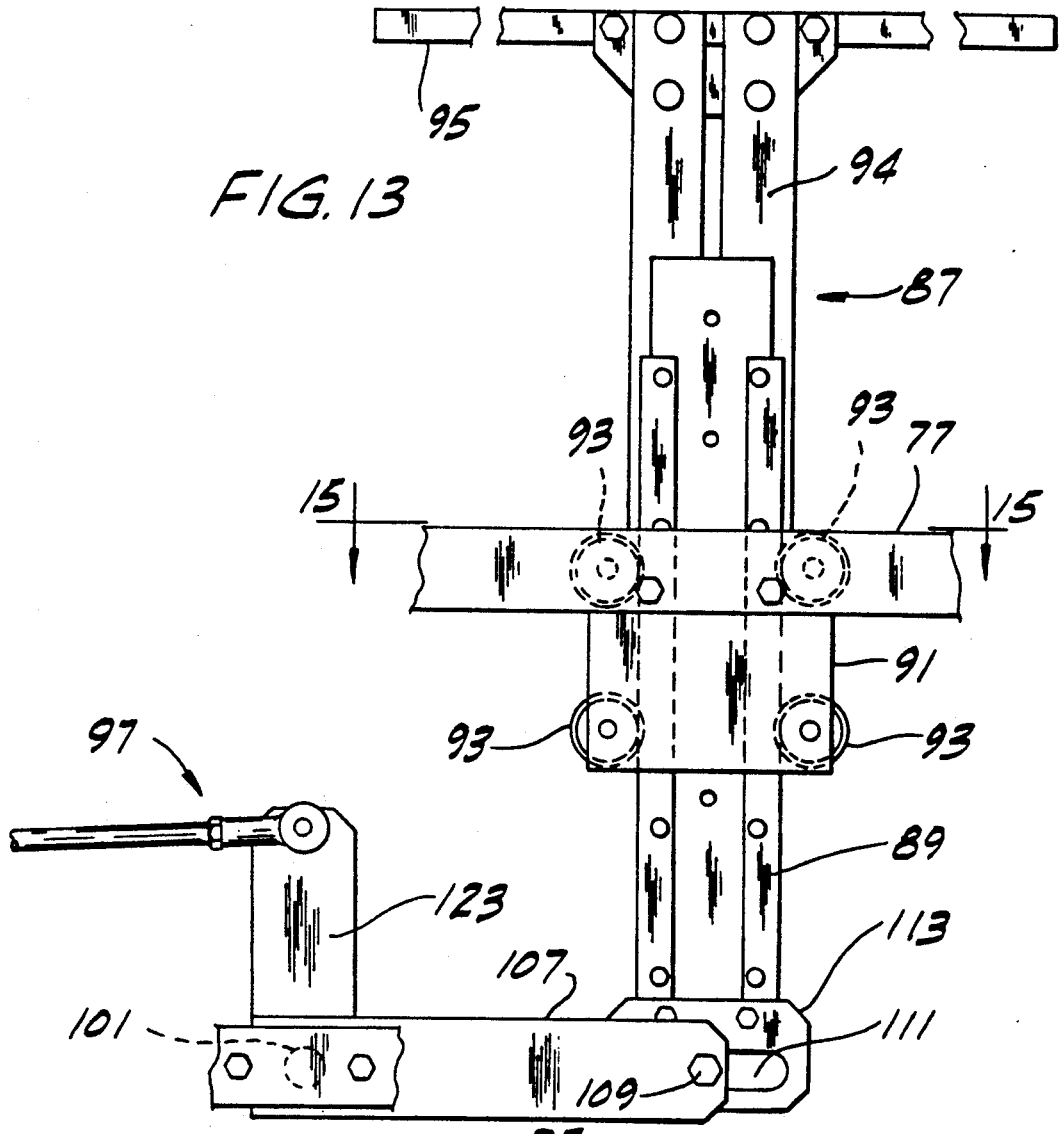
FIG. 13 is a right side elevation of FIG. 12.

In more particular, and referring primarily to FIGS. 8-10, the apparatus 1 is shown to comprise a frame generally designated 47 in which is mounted the conveyor 25 constituted by an endless belt conveyor having a forward-moving upper horizontal reach 25*a* (forward being from right to left as viewed in FIGS. 8 and 9 and as shown by the arrow therein), and a lower return reach. The upper reach is suitably supported, as on rollers (not shown). In the operation of the apparatus, the conveyor may be continuously driven by a drive such as indicated at 51 including an electric motor M. Cases 5 with the cuffed and filled bags therein are delivered to the entrance end of the conveyor (its right end as viewed in FIG. 8) for being conveyed on and by the upper reach 25*a* of the conveyor to the bag uncuffing station S1. Delivery of cases on to the conveyor is under control of an index means 53 (see FIGS. 9 and 11) for holding back a series of cases ready for delivery to the conveyor and releasing one case at a time to be conveyed forward by the upper reach of the conveyor to the uncuffing station S1. The leading case of a row of cases held back by the index means rests on the upper reach of the conveyor against a stop 55 adjacent the right side of the apparatus. An angled adjustable guide 56 is provided at the left side of the apparatus. At 57 is indicated a pusher or gate (the infeed gate) for pushing the case laterally to clear the stop 55, this pusher being actuated by an air cylinder C2. When the case is pushed laterally toward the left side of the apparatus by the pusher to free it from the stop 55, it is conveyed forward by and on the upper reach 25*a* of the conveyor to the uncuffing station S1, being arrested in position at the uncuffing station by engagement of the leading end of the case with a pair of stops or gates 61 at opposite sides of the conveyor 25. Each stop or gate 61 is pivoted as indicated at 63 on a plate 65 adjustable longitudinally of the apparatus on a respective side rail 67 of the apparatus, being releasably clamped in adjusted position on the rail 67 by a clamp means 69. At C3 is indicated an air cylinder carried by the plate 65 for swinging the stop or gate (the uncuffing gate) between a retracted position clear of the path of travel of a case on the tipper reach of the conveyor and an extended position reaching laterally over the upper reach of the conveyor for engagement by the leading end of a case. The two uncuffing station gates 61 and the two cylinders C3 are adjustable longitudinally of the apparatus to different positions for handling cases of different lengths, by adjustment of plates 65.

The case, moved forward by and on the upper reach of the conveyor, is guided in its movement by a pair of side guides each designated 73 each mounted on a brackets 75 extending inwardly at the respective side of the conveyor from a side rail 77. These side rails 77 are laterally adjustable in and out for adjustment of the side guides 73 to accommodate cases of different widths by means such as indicated generally at 79 comprising nuts 81 secured to the bottom of the rails 77 and threaded shafts 83 journalled at opposite sides of the conveyor in the conveyor side frame members 85. The shafts have right-hand threads for the nuts at one side and left-hand threads for the nuts at the other sides so that, on turning the shafts in one direction the side rails 73 are moved toward one another and on turning the shafts in the opposite direction the side rails 77 are moved away from one another.

When the case 5 is conveyed to and held at the uncuffing station S1 by tile uncuffing station gates 61 (the upper reach of the conveyor simply sliding by under the parked case), the uncuffing means 27 is actuated for the uncuffing operation. The uncuffing means comprises left and right side elevator or lift assemblies each generally designed 87 each associated with the respective side rail 77 for adjustment therewith for handling cases of different widths, each lift assembly comprising a vertical member 89 slidable up and down in a lift guide comprising a bracket 91 carried by the respective side rail having grooved guide rollers 93 thereon, the vertical lift member having vertical edges tracking in the grooves of the rollers. Extending up from member 89 is an extension 94 having a horizontal bar 95 at its upper end, each bar 95 extending longitudinally with respect to the apparatus at a respective side of the apparatus. TI)e left-hand bar 95 carries the two left-hand sets 29 of uncuffing fingers 31, 33 and the right-hand bar 95 carries the two right-hand sets 29 of uncuffing fingers. The lift assemblies with the bars 95 are adjustable laterally so that the two left-hand sets 29 of fingers and the two right-hand sets 29 of fingers are adjustable laterally for uncuffing bags in cases of different widths, and are movable upwardly from a lowered retracted position to uncuff the bag in the case at station S1 and back downwardly after the uncuffing has been completed.

Figure 14:
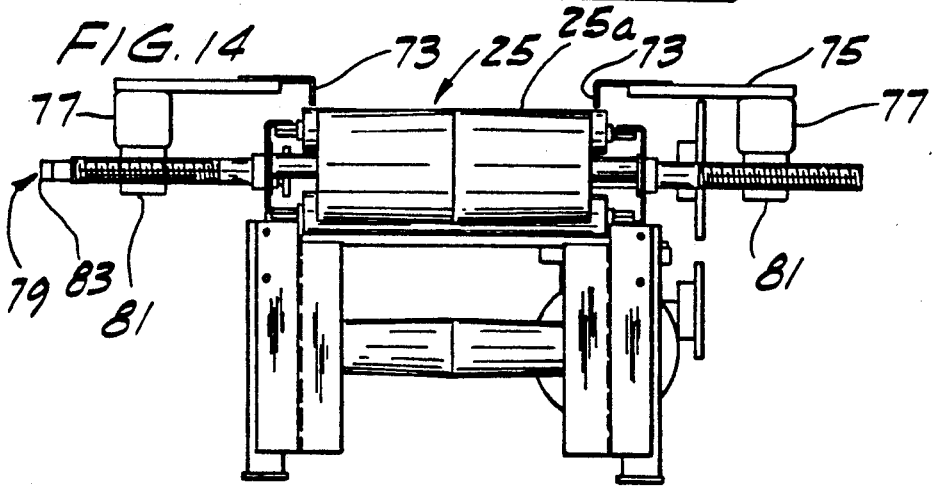
FIG. 14 is an enlargement of the lower part of FIG. 10 with parts omitted and parts shown in section.
Figure 15:
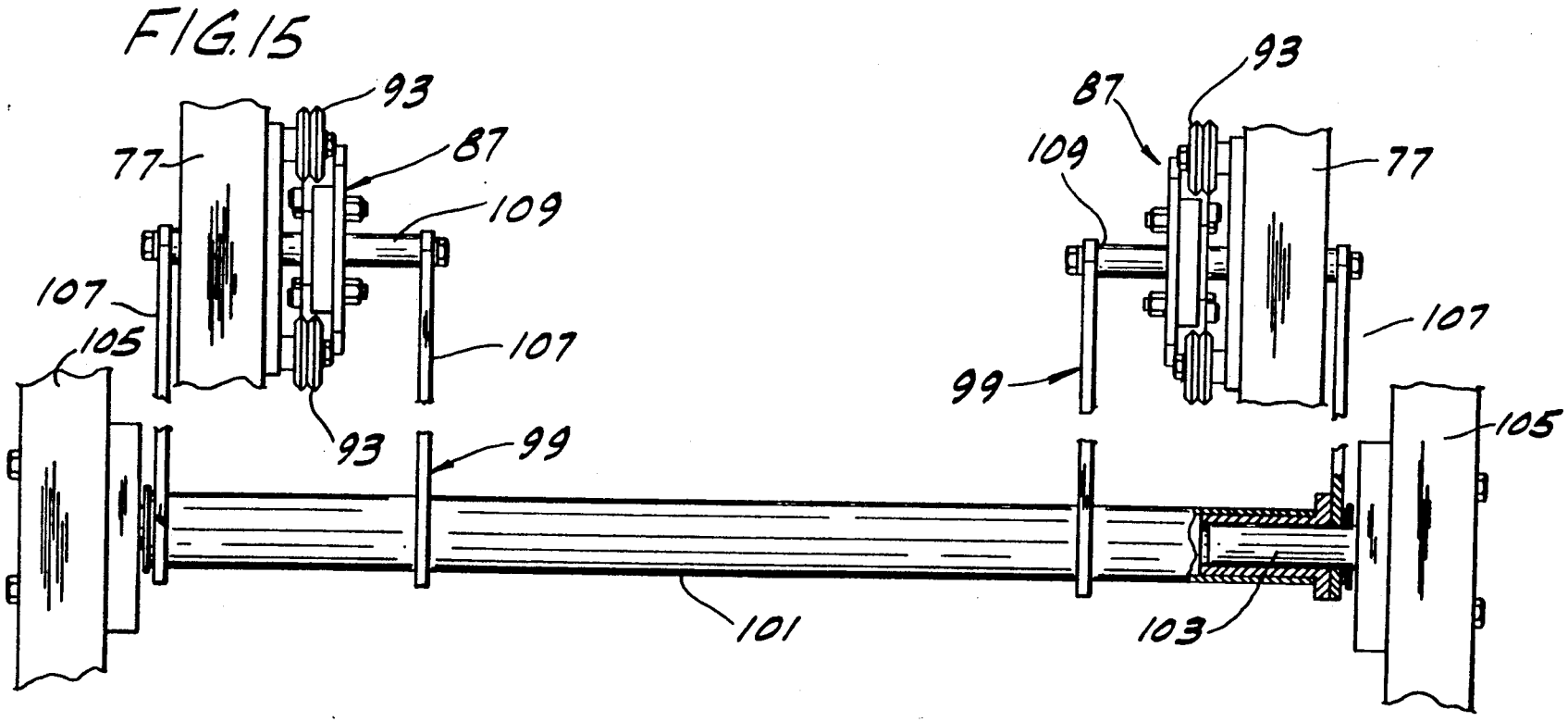
FIG. 15 is a horizontal section generally on line 15—15 of FIG. 13.
Figure 16:
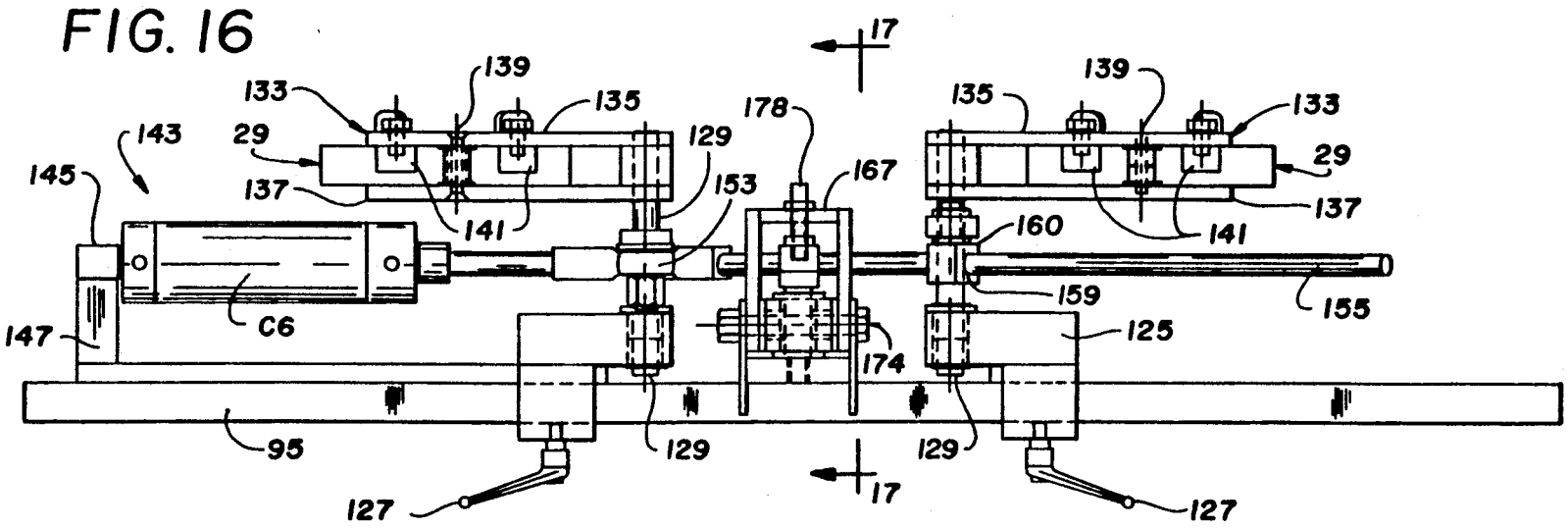
FIG. 16 is an enlarged fragment of FIG. 8.

Means indicated generally at 97 is provided for raising and lowering the left-hand and right-hand lifts 87, this means comprising a pair of levers 99 mounted on a cross-shaft 101 mounted at its ends on stub shafts 103 carried by members 105 of the main framework of the apparatus. Each of these levers comprises a pair of arms 107 spaced axially of the cross-shaft and a pin 109 extending between the arms. This pair extends through a slot 111 in a plate 113 at the lower end of the respective lift 87. An air cylinder C5 pivoted at its tail end on a bracket 117 has its piston rod 119 extending rearward to a connection at 121 with an arm 123 extending up from the cross-shaft 101. The arrangement is such that with the piston rod 119 extended, the lifts 87 occupy their lowered position of FIG. 8 and when the piston rod 119 is retracted, the cross-shaft 101 is rotated counterclockwise as viewed in FIGS. 8 and 14 to swing the levers 99 carrying the pins 109 upward thereby to raise the lifts. Each lift comprises parts 89 and 94 which are vertically slidable relative to one another for adjustment of the height of the lift and the height of the top bar 95 of the lift. The two arms 107 of each lever 99 are so spaced as to permit the requisite lateral adjustment of rails 77 and the lifts 87.

For each of the four sets 29 of uncuffing fingers 31, 33, a bearing member 125 is mounted on the respective lift top bar 95 for sliding adjustment lengthwise of the bar to different positions for accommodating cases of different length, each bracket being adapted to be locked in adjusted position by a clamp screw 127. Each member 125 has a vertical shaft 129 journalled therein, tile shaft extending up from the member 125. Secured on the upper end of the shaft is a swing arm 133 comprising an upper part 135 and a lower part 137. The hub 34 of each set 29 of fingers 31, 33 is pivoted as indicated at 139 between the upper and lower parts of the swing arm with the fingers 31, 33 extending inwardly from the swing arm, the fingers being generally held in their positions relative to the swing arms shown in FIGS. 18 and 19 by their engagement with cushioned (rubber) stops 141 located between the parts of the swing arm, with some slight play permitted for the set of fingers.

Figure 18:
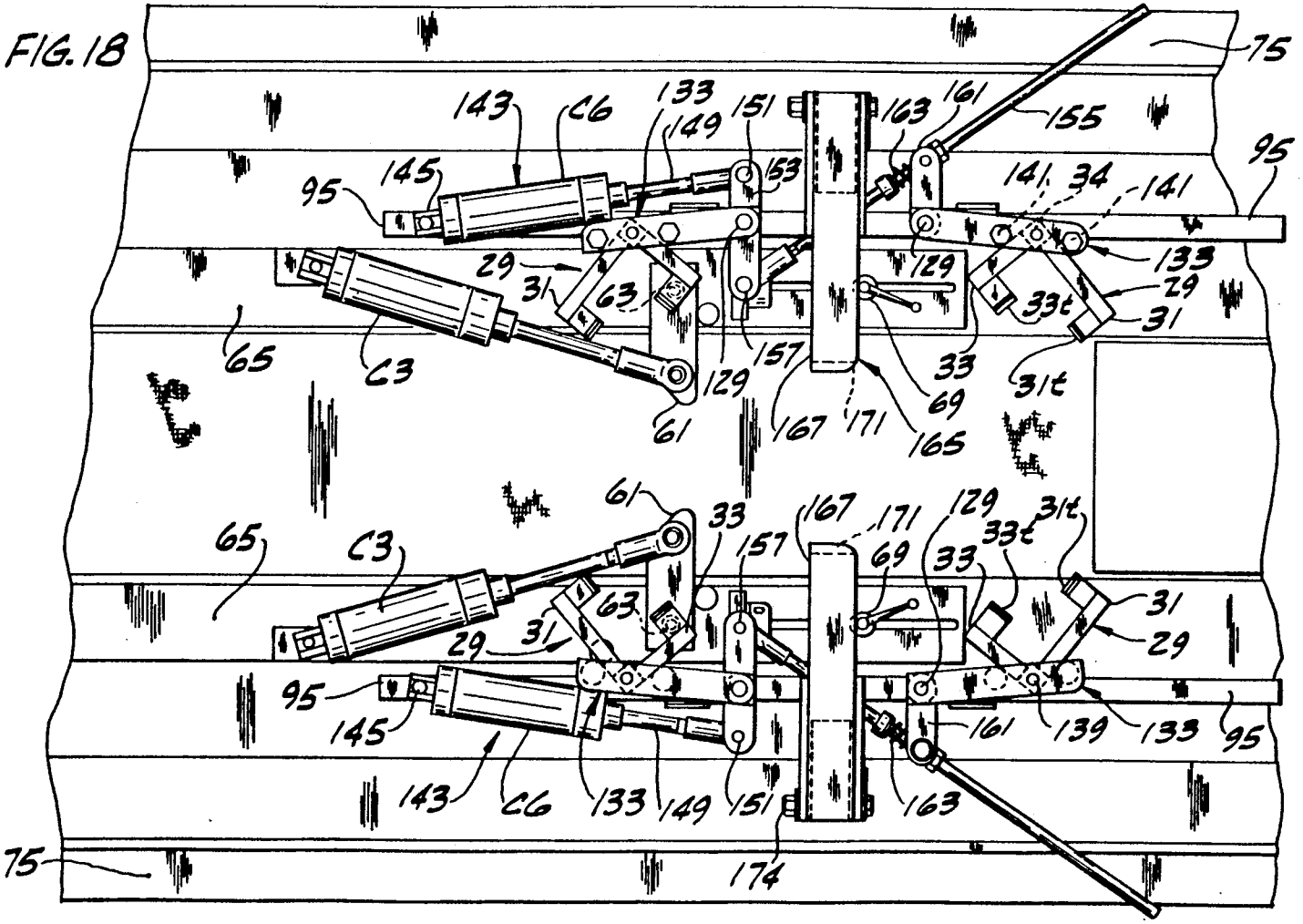
FIG. 18 is a plan of FIG. 17 showing uncuffer fingers of the apparatus in retracted position for movement of a case to position at an uncuffing station for uncuffing of a bag in the case.
Figure 19:
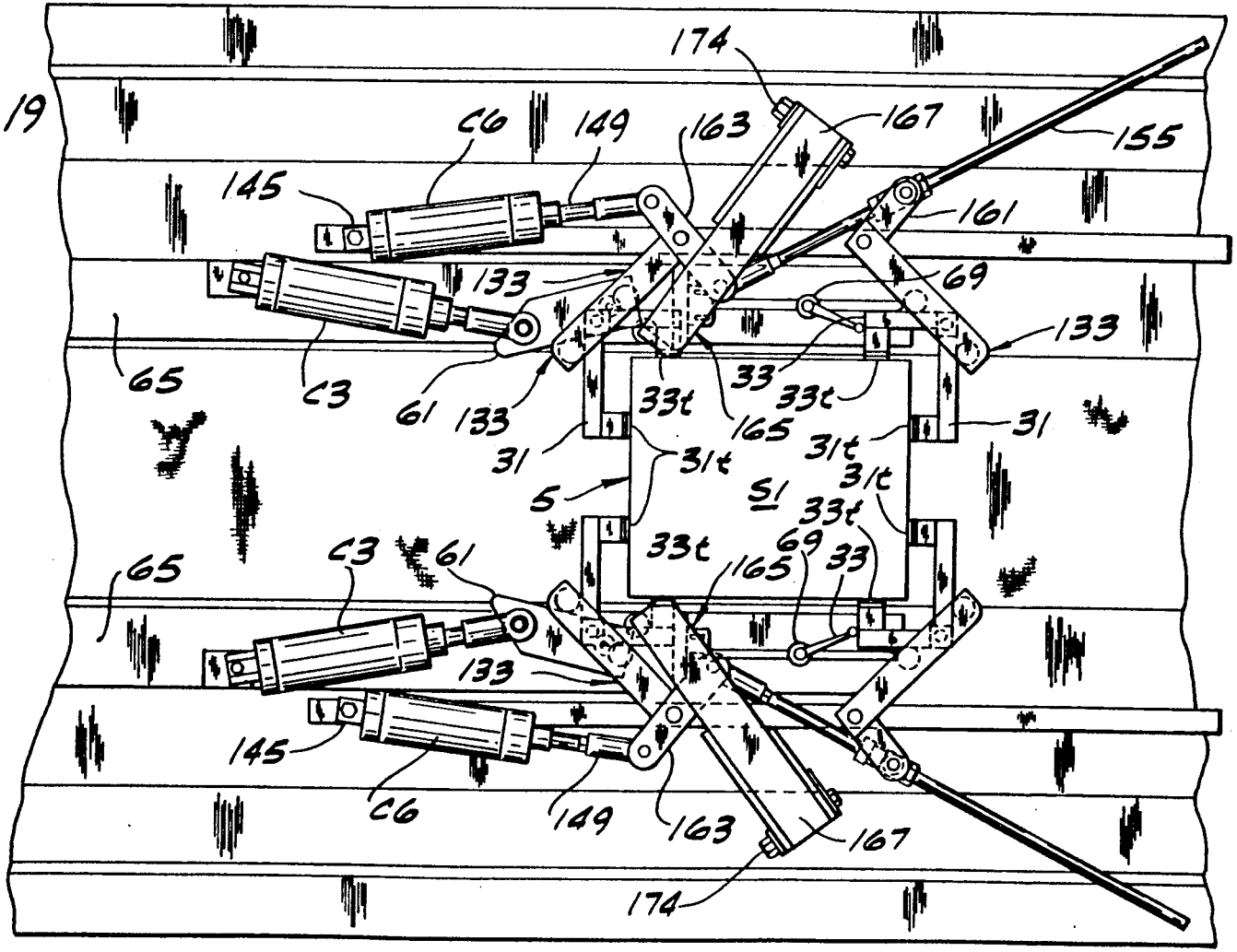
FIG. 19 is a view similar to FIG. 18 showing the uncuffing fingers swung in to uncuffing position engaging the case at the uncuffing station.

Each of the swing arms 133 is adapted to be swung inwardly from the retracted position in which it appears in FIG. 18 wherein the rearward sets 29 of fingers are located laterally outward of a case 5 being fed forward by the conveyor 25, to the advanced or extended position in which it appears in FIG. 19 wherein the tips 31*t* of the forward sets engage the forward end of the case at the uncuffing station S1 and the tips 33*t* of the forward sets engage the sides of the case adjacent its forward end, and the tips 31*t* of the rearward sets engage tile rearward end of the case and the tips 33*t* of the rearward sets engage the sides of the case adjacent its rearward end. As shown in FIG. 19, the right-angled V formation of each set of fingers straddles a respective vertical corner of the case. With the lifts 87 and the fingers in their lowered position, the tips of the fingers engage the case below the lower edge of the cuff 23.

Each of the swing arms 133 is swung in and out by means indicated generally at 143 comprising an air cylinder C6 having its tail end pinned as indicated at 145 to a cylinder support 147 associated with the forward bearing 125 and having its piston rod 149 extending rearward to a pin connection at 151 with the outer end of a lever 153 which is secured intermediate its length to the forward shaft 129 which carries the forward swing arm 133. A rod 155 pin-connected at 157 to the inner end of the lever 153 extends slidably through an opening 159 in a member 160 pivoted in the outer end of a crank arm 161 on the rearward shaft 129, with a spring connection such as indicated at 163 between the rod 155 and the rearward shaft 129. The arrangement is such that with the piston rod 149 of each cylinder C6 extended, the swing arms 133 are in their retracted position shown in FIG. 18. On extension of the piston rod 149 of each cylinder C6, the respective forward shaft 129 is rotated on its vertical axis in the direction to swing the respective forward swing arm 133 in, and the respective rearward shaft 129 is rotated via the respective connecting rod 155, the spring connection 163 and arm 161 to swing the respective rearward swing arm 133 in for engagement of the four sets of uncuffing fingers with the corners of the case as illustrated in FIG. 19.

Figure 17:
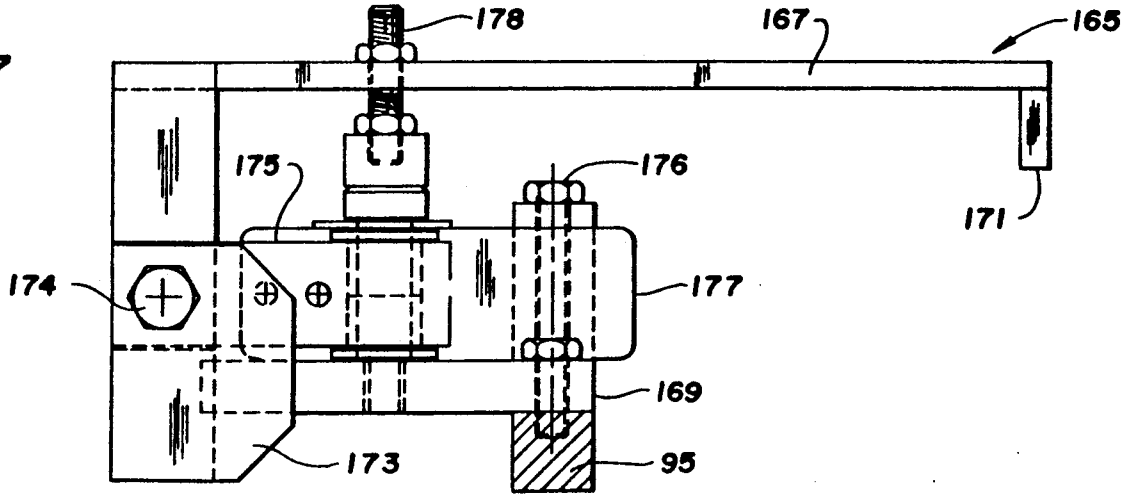
FIG. 17 is an enlarged vertical section on line 17—17 of FIG. 16.

At 165 is generally indicated means for folding down the side (major) closure flaps 15 of the case 5 at the uncuffing station S1 and holding them down for the flattening of the bag top. This means comprises, for folding down each major flap, an arm 167 carried by a bracket 169 on the top bar 95 of the lift at the respective side of the apparatus so as to be raised and lowered with the lift, and to be swingable both horizontally and vertically relative to the lift. As appears in FIGS. 4 and 17, the arm 167 has a downwardly extending flap-hooking finger 171 at its inner end and side members 173 at its outer end pivoted on a pivot as indicated at 174 on a pivot block 175 pivoted on the bracket as indicated at 176 for swinging about a vertical axis. Each arm is biased by leaf spring means indicated at 177 to swing horizontally to a position extending transversely of the apparatus as shown in FIG. 18 and is gravity-biased to swing down on the pivot at 174 to the horizontal position in which it is shown in FIG. 17. At 178 is indicated an adjustable stop for the arm. The arrangement is such that the leading end of a case being fed to the uncuffing station engages the arms 167 and swings them forward and aside. On raising the lifts 87 for the uncuffing of the bag at the uncuffing station, the arms 167 are raised (along with the lifts) and swing back to a position extending over the upper edges of the major flaps 15 of the case. Then, on lowering the lifts, the fingers 171 hook the major flaps and swing them out generally to the position such as shown in FIG. 4. This clears the top portion of the bag for being flattened.

Figure 20:
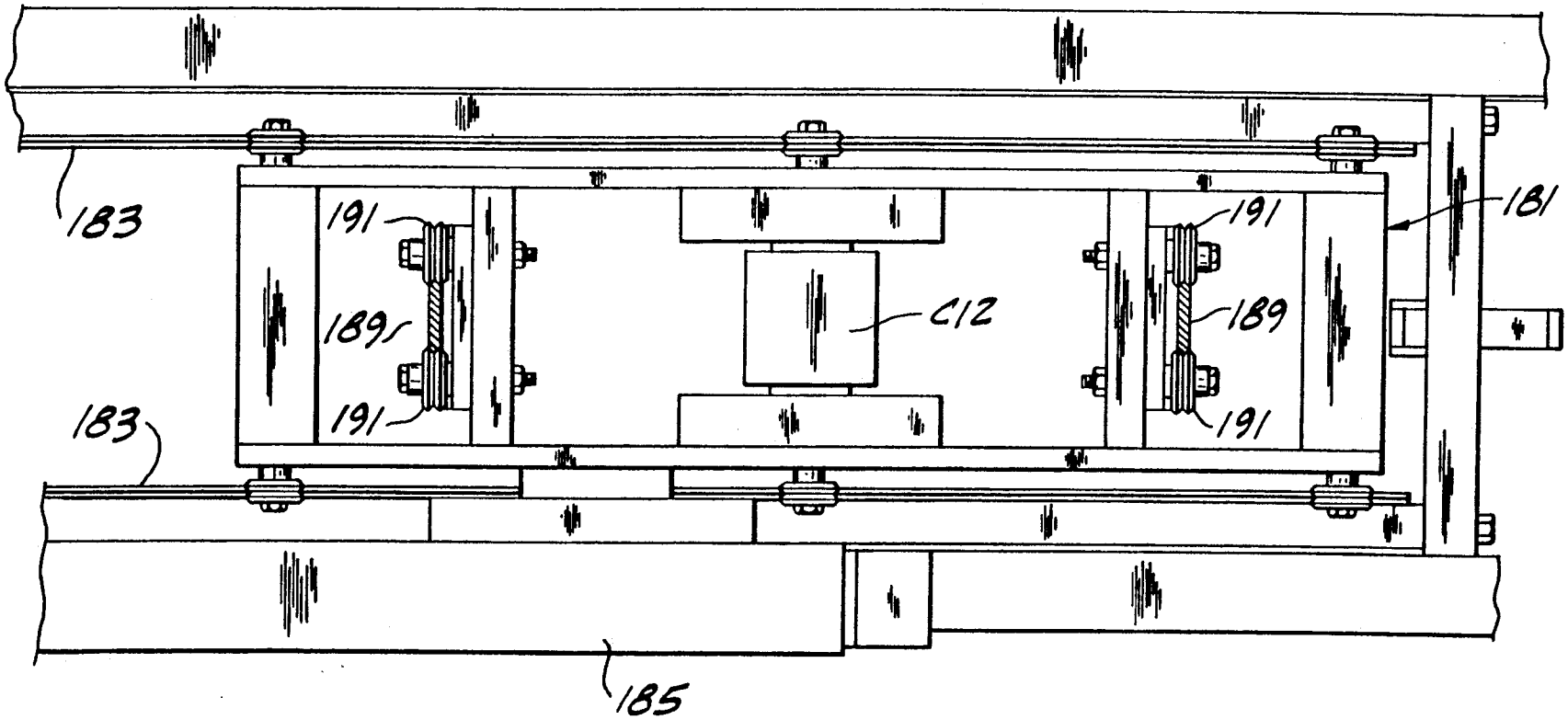
FIG. 20 is an enlarged fragment of FIG. 9.
Figure 23:
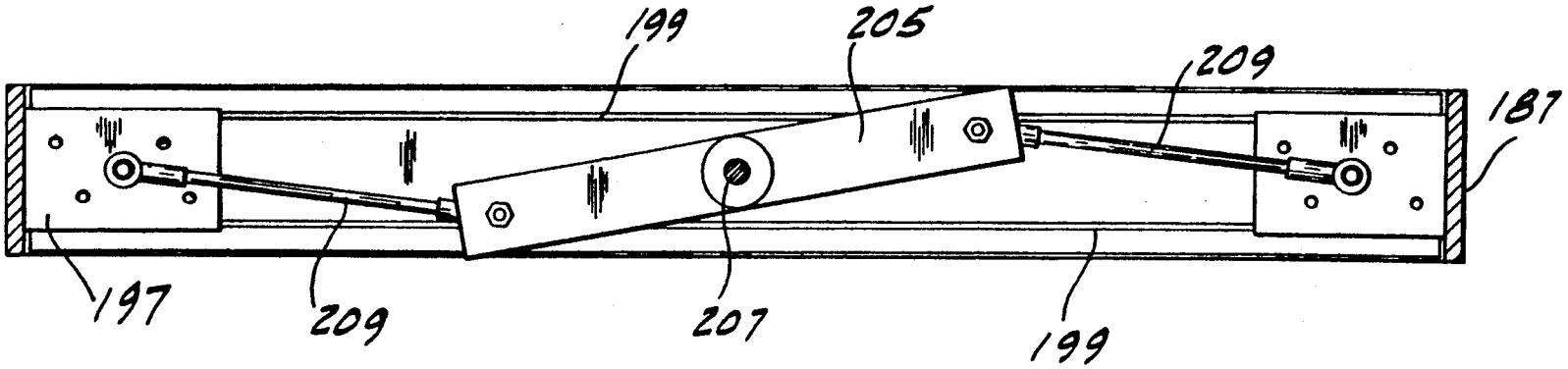
FIG. 23 is a view on line 23—23 of FIG. 21.

The means 35 for flattening the uncuffed top of the bag comprises a carriage 181 movable longitudinally of the apparatus on rails 183 in the frame of the apparatus between a rearward retracted position above the uncuffing station S1 to a forward advanced position at a forward station S2, referred to as the tape section station, by a band cylinder indicated at 185 (see FIG. 20). An elongate head 187 is mounted for up and down movement relative to the carriage between a raised retracted position in which it appears in solid lines in FIG. 8 and the lowered position in which it is indicated in phantom in FIG. 8. For this purpose the head has members 189 extending vertically upwardly from the head slidably guided in guide rollers 191 on the carriage, and is movable up and down by means of an air cylinder C12 carried by the carriage. The head carries a pair of intucking or gusseting blades each designated 195 for intucking the forward and rearward portions of the upstanding uncuffed bag top at the uncuffing station S1. These blades extend down from slides 197 guided for horizontal sliding movement longitudinally of the head in the vertical central longitudinal plane of the apparatus on a pair of side rails 199 at the bottom of the head (see FIG. 23). Provision is made for adjusting the blades vertically with respect to the slides as indicated at 201. The slides carrying the blades are movable toward one another from a retracted position (in which they are shown in solid lines in FIG. 21) at the ends of the head to an extended position wherein they generally meet at the center of the head (as shown in phantom in FIG. 21) for the intucking operation. Means for moving the slides between these two positions is shown to comprise an air-operated rotary actuator C10 leaving a double crank 205 on its shaft 207, the double crank being connected to the slides by links 209. The arrangement is such that on operation of the rotary actuator C10 to rotate the crank 205 in one direction, the slides are moved away from one another to their spread-apart position, and on operation of the rotary actuator to rotate the crank in the opposite direction, the slides are moved toward one another for tile intucking or gusseting operation.

Figure 6:
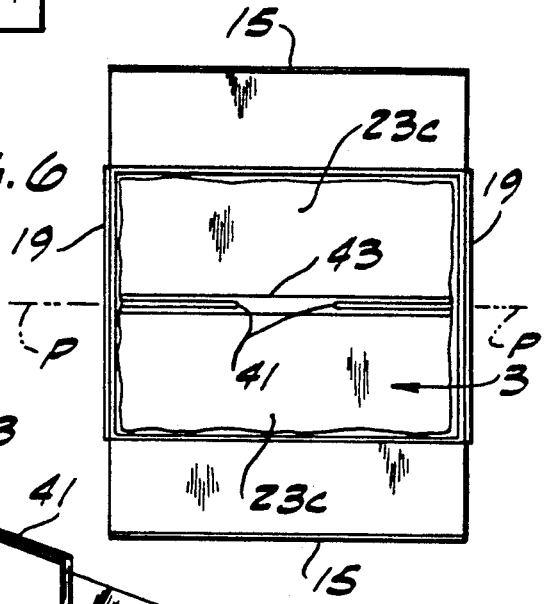
FIG. 6 is a plan of FIG. 5.
Figure 5:
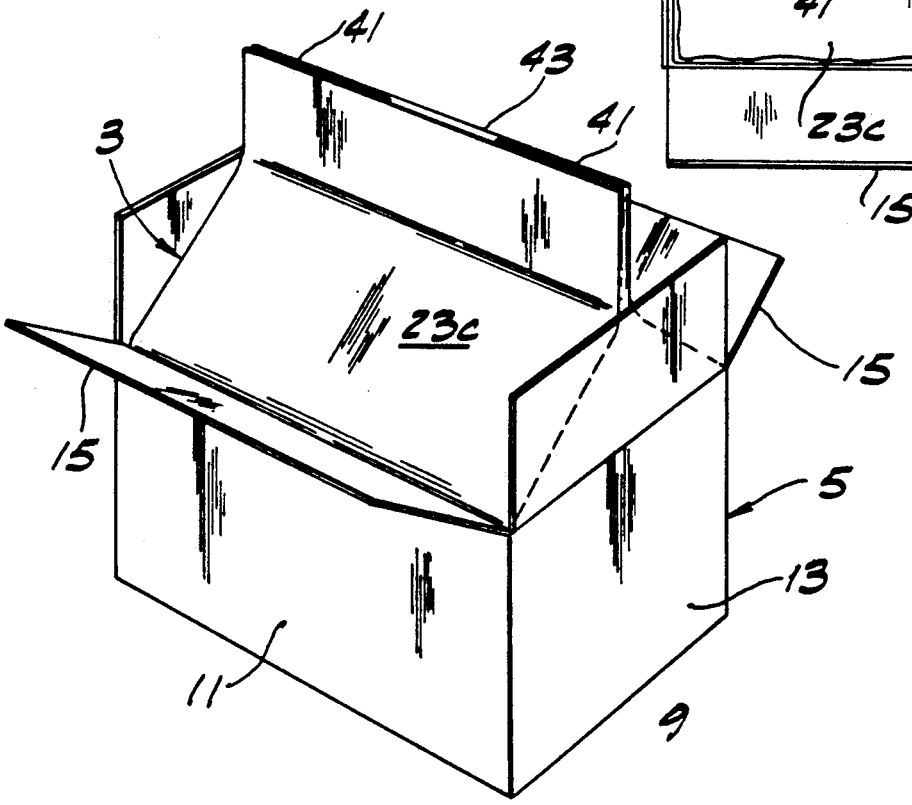
FIG. 5 is a perspective showing the bag top flattened.
Figure 7:
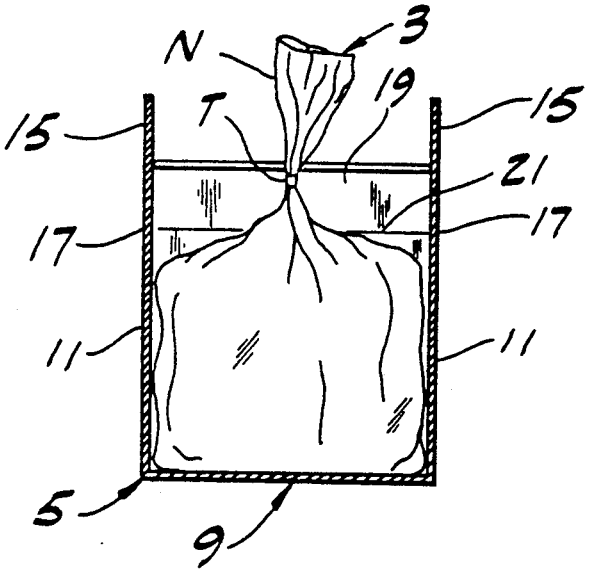
FIG. 7 is a view showing the bag top formed into a neck and the neck taped closed.

The head 187 further carries the pair of bag clamps each generally designated 39, one at the right and tile other at the left, for clamping the upstanding uncuffed bag top at the uncuffing station to bring together the opposite side portions 23c of the bag top to flatten the tops generally in the aforesaid vertical plane lying generally centrally between the sides of the case 5 at the uncuffing station S1. Each bag clamp comprises an arm 213 extending radially from a shaft 215 mounted in The head and a bar 217 pivotally mounted at the free end of the arm. Each shaft 215 extends longitudinally in the head, being journalled in bearings 219 carried by the head and adapted to be rotated one way or the other by an air-operated rotary aduator C11. The clamps 39 normally occupy the swung-out retracted position in which they are shown in phantom in FIG. 22. They are swingable inwardly toward one another to the position shown in solid lines in FIG. 22 in which the bars 217 engage the opposite sides of the bag top and flatten it, with the intucks or gussets 41 between the sides of the top as shown in FIG. 6.

Figure 21:
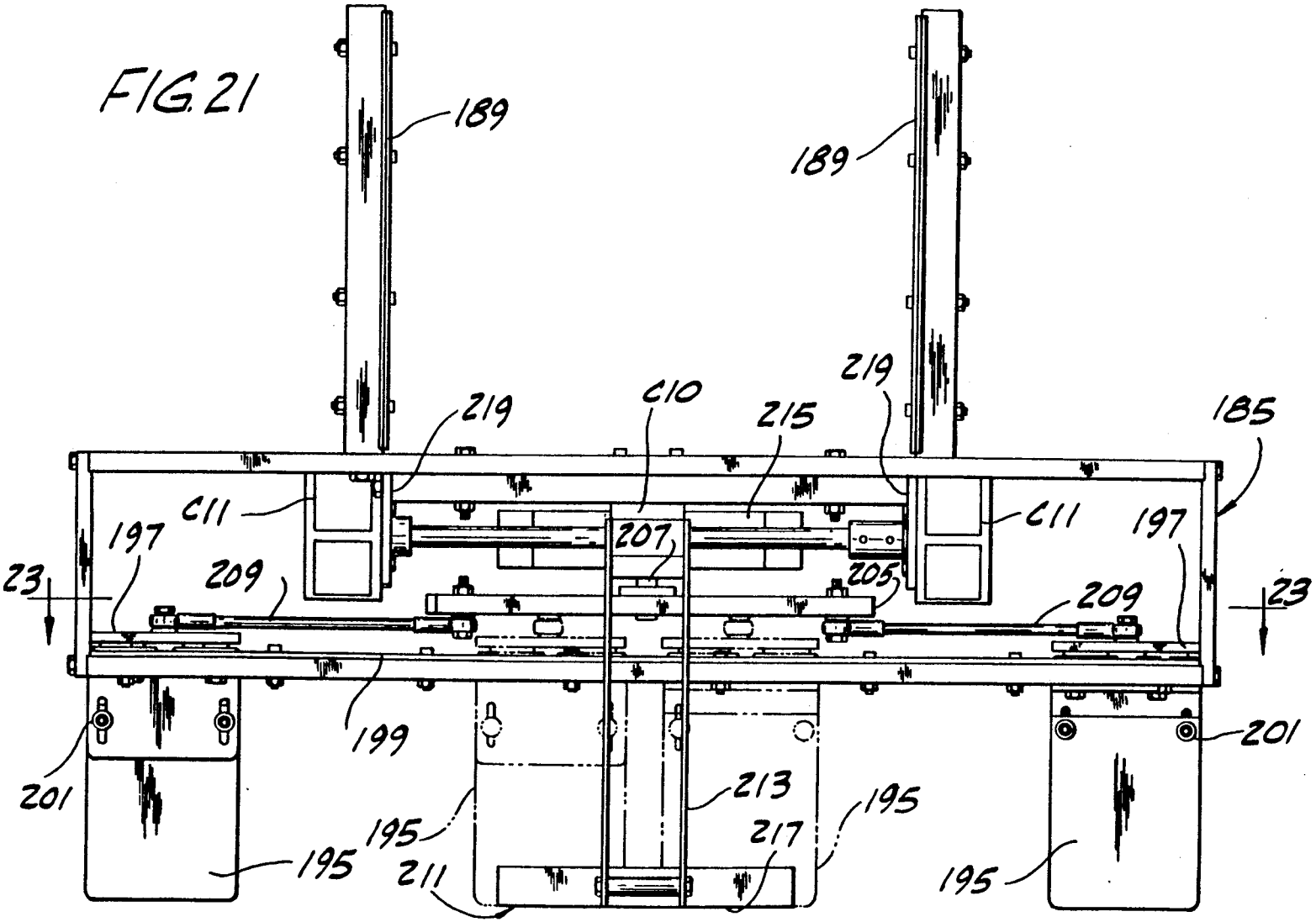
FIG. 21 is an enlarged fragment of FIG. 8.

The intucking blades 195, in their outer, spread-apart retracted position shown in solid lines in FIG. 21 are located outward of the forward and rearward portions 23a, 23b of the uncuffed bag top 23, and the bag clamps 39, in their swung-out retracted position, are located outward of the side portions 23c of the uncuffed bag top. With the intucking blades 195 and the bag clamps 39 in their stated retracted positions, the head 187 is moved down by operation of cylinder C12 to a lowered position such as indicated in phantom in FIG. 8 wherein the intucking blades extend down on the outside of the forward and rearward portions 23a, 23b of the bag top generally in the vertical central longitudinal plane of the apparatus (and generally in the plane P) and wherein the bag clamps 39 are so positioned heightwise that when swung inward toward one another they engage the outside of the side portions 23c of the bag top for flattening it. With the head so lowered, the intucking blades 195 are moved inwardly toward one another in the vertical central longitudinal plane of the apparatus generally to the point where they more or less meet at the center of the case (as shown in phantom in FIG. 21). As they move inward, they engage and tuck in the forward and rearward portions 23*a*, 23*b* of the bag top to form the gussets indicated at 41. The bag clamps 39 then swing in to flatten the sides of the bag top against the intucking blades 195.

Figure 27:
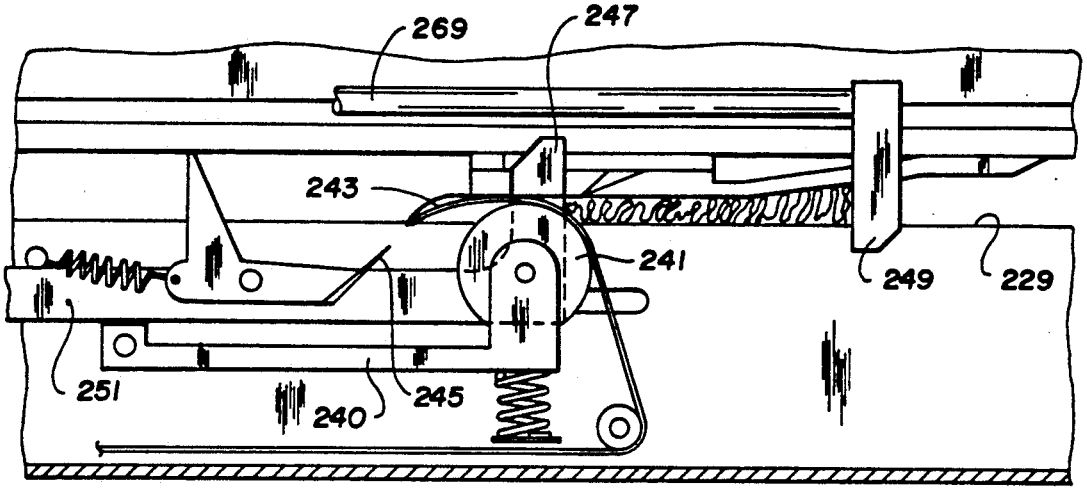
FIG. 27 is a semi-diagrammatic view based on FIG. 24 showing an initial phase of the formation of a neck for a bag.
Figure 28:
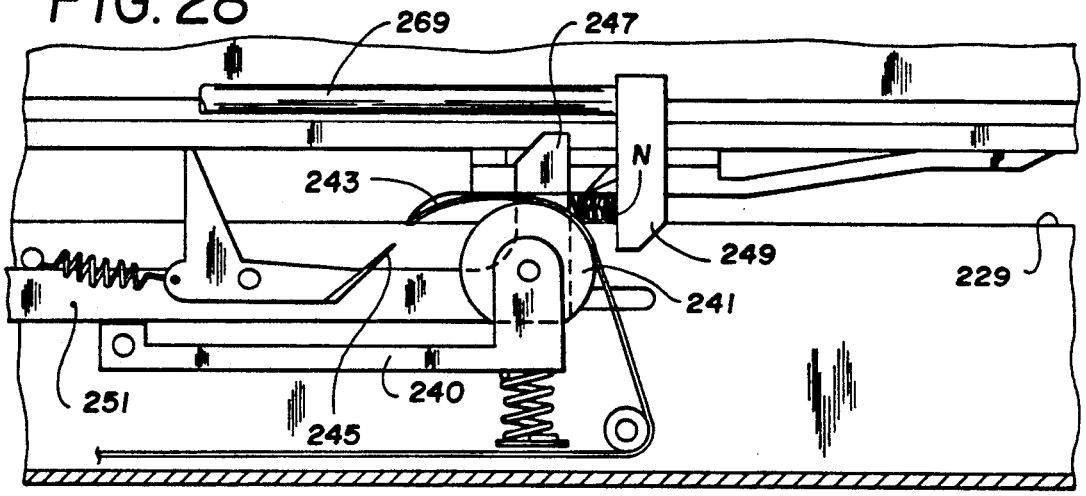
FIG. 28 is a view similar to FIG. 27 showing the completion and compacting of the neck.
Figure 29:
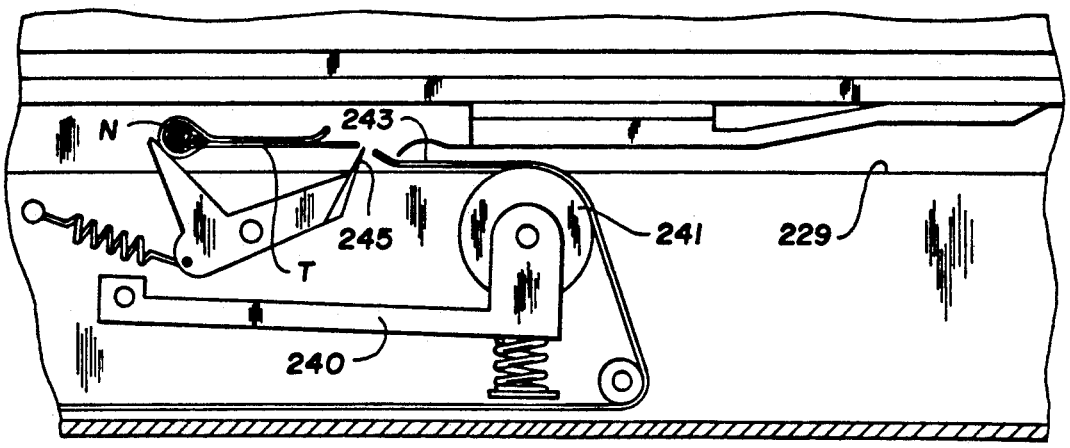
FIG. 29 is a view similar to FIGS. 27 and 28 showing the completion of the taping of the neck.

Following the flattening of the bag top generally in the vertical central longitudinal plane of the apparatus (plane P), the case stops or gates 61 are retracted by the cylinders C3. The case moves forward and the carriage 181 carrying the head 187 is moved forward by the cylinder C9 generally in unison with the case, the intucking blades 195 being retracted but the bag clamps 39 remaining closed. As the case moves forward, its leading end engages a gate or stop 223 (referred to as the taping gate) to stop the case at a second station S2. Here the top of the bag is in the bag top closure section 45, which comprises a pair of hollow beams 225 and 227, 225 being the left-hand beam and 227 being the right-hand beam. These beams are mounted in horizontal position side-by-side and spaced apart to have a slot 229 between them at the lower end of a vertical support structure 231 extending down at the forward end of the frame of the apparatus. The beams 225 and 227 extend forward and rearward from the support structure 231, with a major portion of the beams cantilevered rearward from the support structure at a level such as to receive the flattened top portion 43 of a bag in the slot 229. Curved guides 233 are provided at the forward ends of the beams for guiding the flattened bag top into the slot 229 between the beams. Rods forming plows for plowing down the leading minor flap 19 and the trailing minor flap 19 are indicated at 235. The flattened bag top is gathered or accumulated and compacted in the slot 229 to form a narrow neck for being tied, means indicated generally at 237 being mounted in the slot between the beams intermediate the length of the beams for applying a tape to the neck in essentially the same manner as disclosed in the aforesaid U.S. Pat. No. 4,912,913, which is incorporated herein by reference. At 239 is indicated means for holding a roll of pressure-sensitive adhesive tape at one side of the beam 225 and at 240 is indicated a spring-loaded arm corresponding to the spring-loaded arm 36 of said patent. At 241 is indicated an applicator wheel corresponding to the applicator wheel 40 of said patent; at 243 is indicated a spring corresponding to the spring 46 of said patent, and at 245 is indicated a blade on a pivot arm such as indicated at 52 and 49 in said patent (from which full details may be ascertained). The flattened bag top, moving forward in the slot 229 between the beams 225 and 227, encounters a bag top stop, 247 extending across the slot from beam to beam, this stop having a home position in which it is located generally directly above the center of the case arrested by gate 223 in position S2, the flattened top being gathered or crumpled up in the slot against this stop as appears in FIG. 27. After the case has reached and been stopped in position S2 by gate 223, a pair of accumulator fingers 249 moves in from a retracted position outside the slot (see FIG. 24) to an operative position extending across the slot at the rear end of the bag top, and is moved forward to complete the gathering or crumpling of the bag top to form it into the stated narrow neck N (see FIG. 28) . This accumulation or gathering occurs just rearward of the wheel 241. Then the case is released to continue its forward travel by the conveyor and the fingers 249 and the stop 247 move forward together to move the neck of the bag forward through the taping mechanism as illustrated in FIGS. 28 and 29 for the application of the tape T to the neck Gate 223 is controlled by an air cylinder C4, being mounted together with the cylinder C3 for adjustment to different positions longitudinally of the apparatus, being locked in adjusted position by a clamp screw 69.

Figure 24:
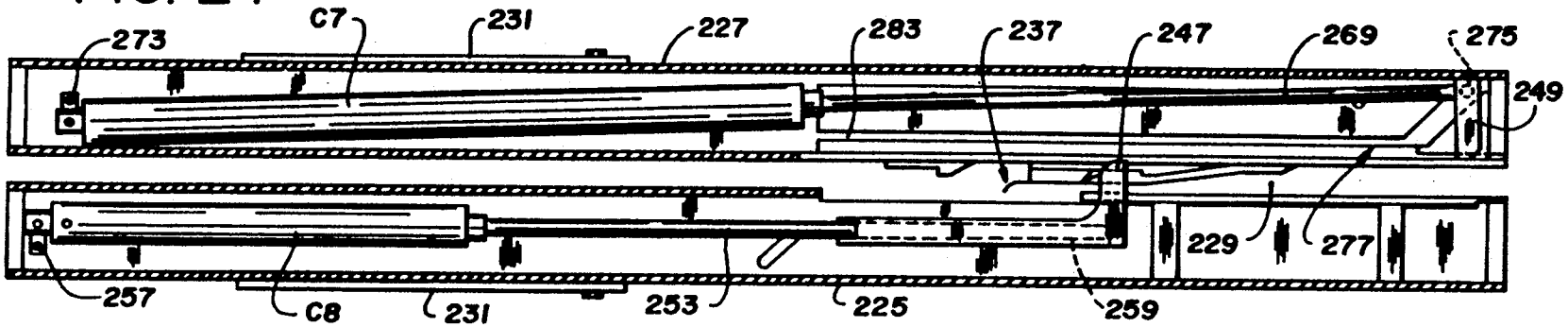
FIG. 24 is a view in horizontal section on line 24—24 of FIGS. 8 and 26 showing certain accumulator fingers and a stop in a rearward home position.
Figure 25:
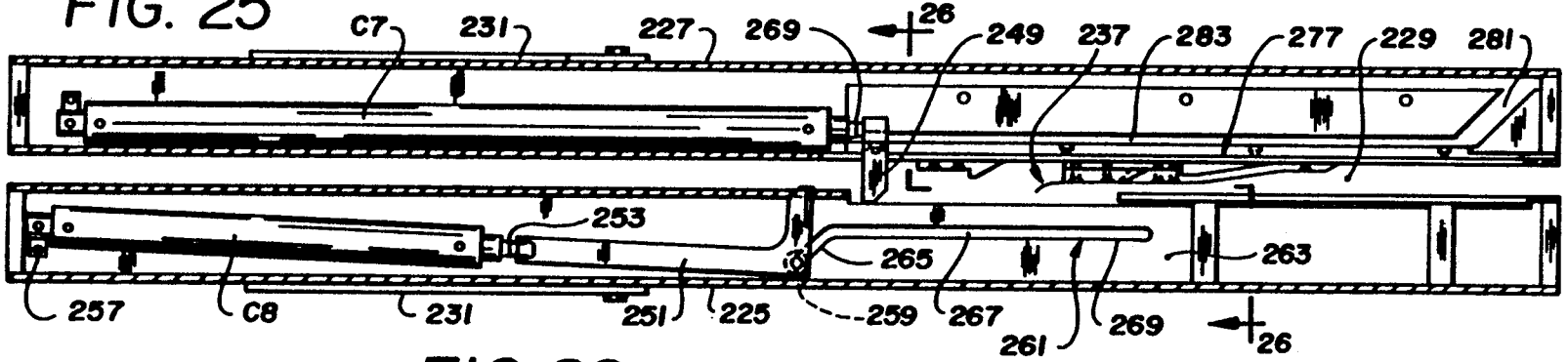
FIG. 25 is a view similar to FIG. 24 showing the accumulator fingers and stop in a forward position.
Figure 26:
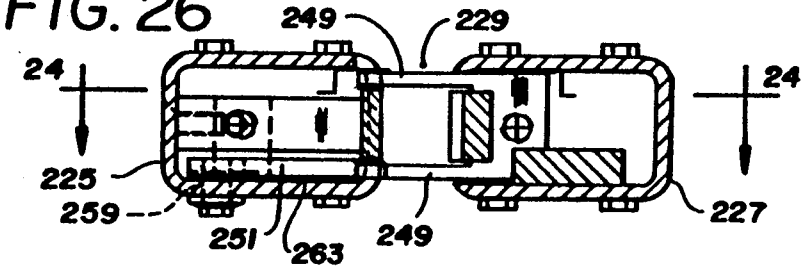
FIG. 26 is a vertical transverse section on line 26—26 of FIG. 25.

The bag top stop 247 is constituted by a finger at the rearward end of an arm 251 which extends rearward from the end of the piston rod 253 of an elongate air cylinder C8 mounted in the beam 225, pivoted at its tail end as indicated at 257 in beam 225. The arm 251 has a cam track follower 259 which rides in a cam groove 261 of a cam track member 263 mounted in the beam 225. The groove 261 has an outwardly and forwardly angled reach 265 at its forward end forward of (downstream from) the taping means 237 and a reach 267 which extends rearward (in upstream direction), from the inner end of the angled reach 265 to a point generally directly above the center of a case at position S2. With the piston rod 253 extended, the finger 247 occupies the home position in which it is shown in FIG. 24 generally rearward of (upstream from) the taping means and extending laterally from the beam 225 through a slot 269 in the beam 225 across the slot 229. When the piston rod 253 is retracted, the finger 247 is moved forward, maintaining its position extending across the slot until the cam follower 259 reaches the angled portion 265 of the cam groove 261, whereupon the finger moves outwardly into the beam 225 to a slot-clearing position in the beam as illustrated in FIG. 25, and as permitted by swinging of the cylinder C8 on its pivot 257. When the piston rod 253 is extended, the finger 247 is returned to its home position of FIG. 24.

The two accumulator or pusher fingers 249 are mounted at the end of the piston rod 269 which extends rearward from an elongate air cylinder C7 pivoted at its tail end in the beam 225 as indicated at 273. The fingers 249 extend laterally with respect to the beam, being vertically spaced apart with one finger above and the other below the taping means 237. Associated with the fingers 249 is a cam track follower 275 which rides in a cam groove 277 provided in the beam 227. The groove has an inwardly and forwardly angled rear end portion 281 leading to all elongate portion 283 which extends generally parallel to its slot 229 generally longitudinally of the apparatus. With the piston rod 269 extended, the fingers 249 occupy the home position in which they are illustrated in FIG. 24 rearward of the home position of the stop 247 and withdrawn laterally from slot 229 into the beam 227, the cam follower 275 reposing in the rearward outer end of the angled portion 281 of the cam groove 277. When the piston rod is retracted, the follower 275 rides inwardly in the angled portion 281 of the groove and the fingers 249 are thereby extended across the slot 229 rearward of the trailing end of the flattened bag top.

Figure 30A:
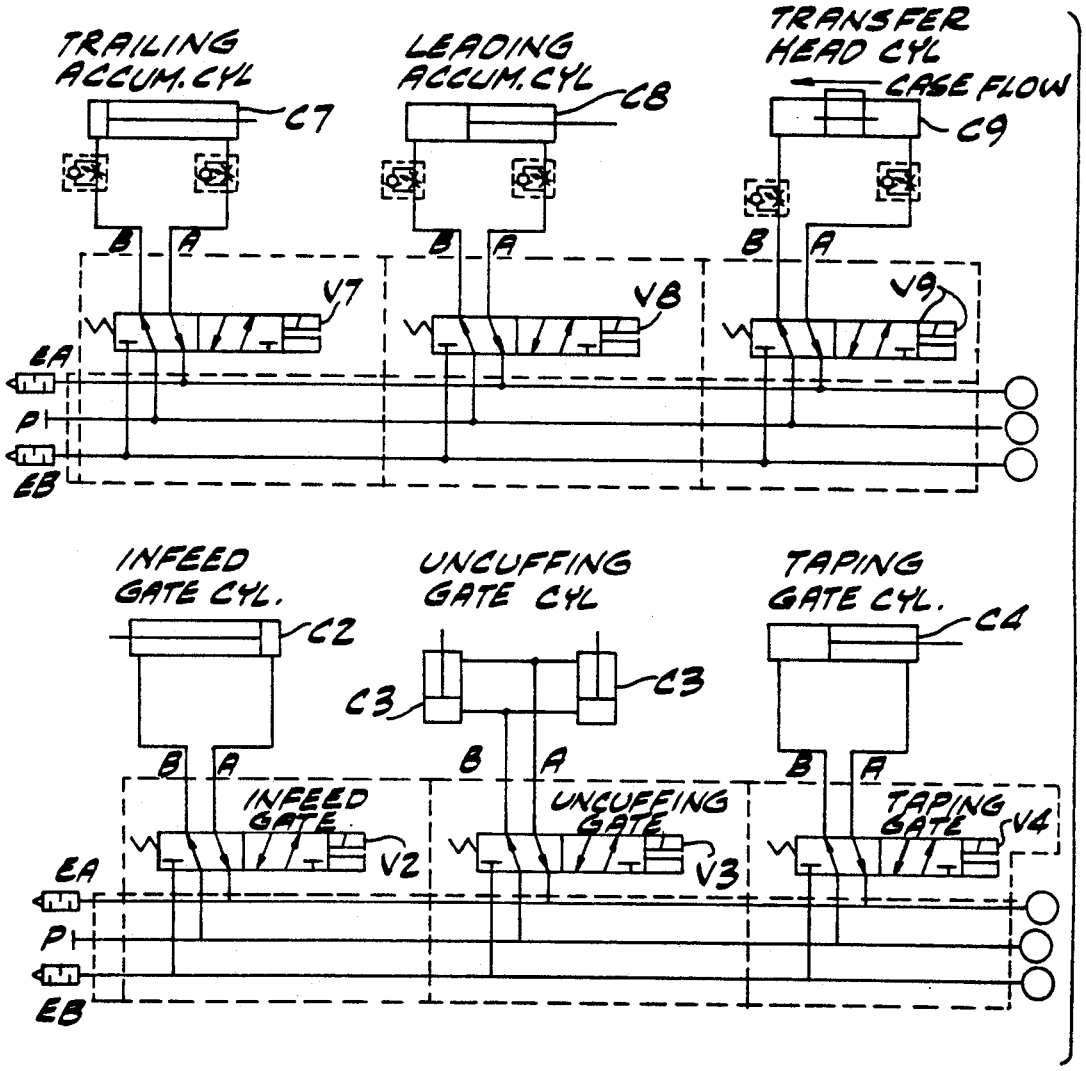
FIG. 30A and 30B together constitute a pneumatic circuit diagram.
Figure 30B:
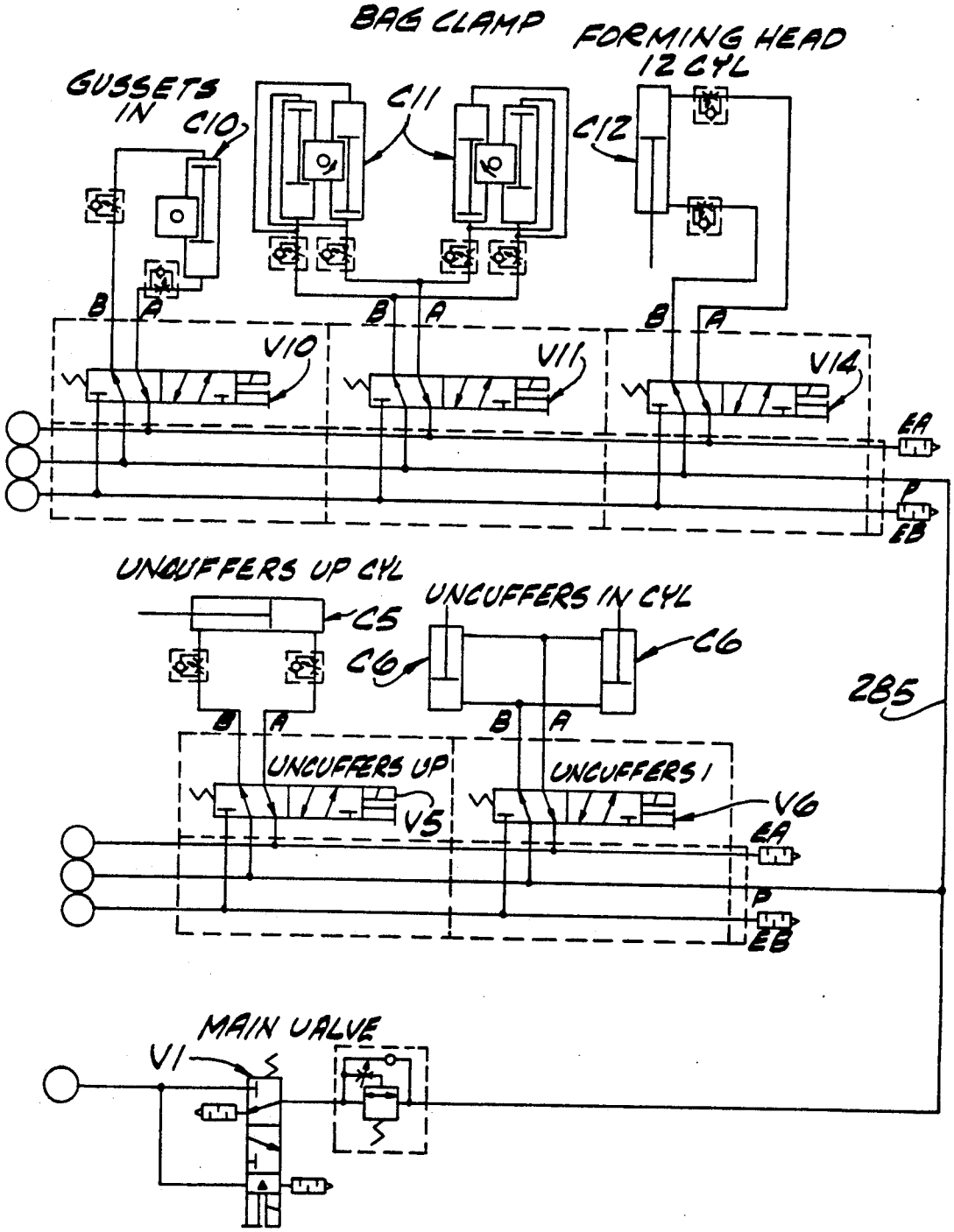
Figure 31A:
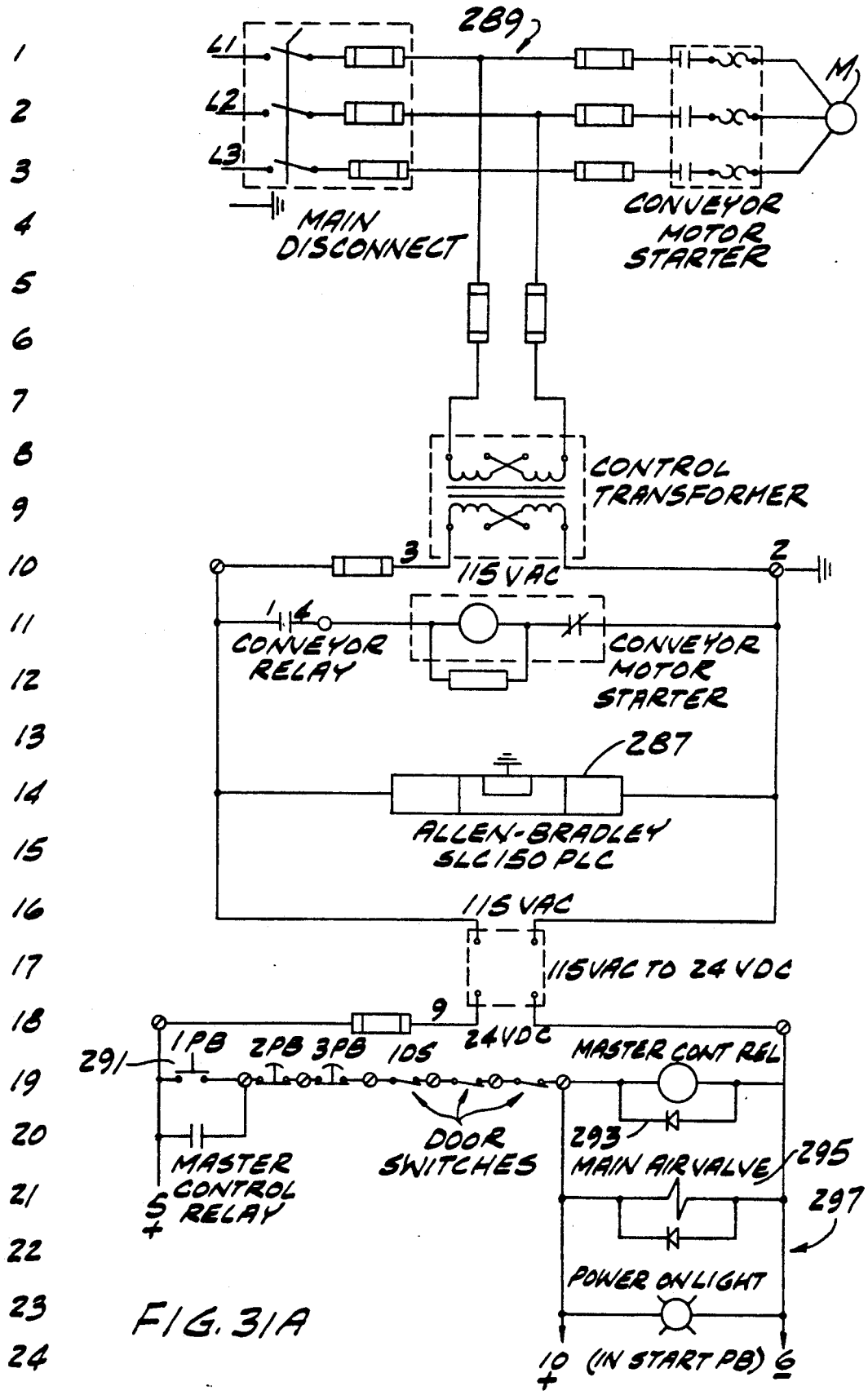
FIGS. 31A, 31B and 31C together constitute an electrical circuit diagram.
Figure 31B:
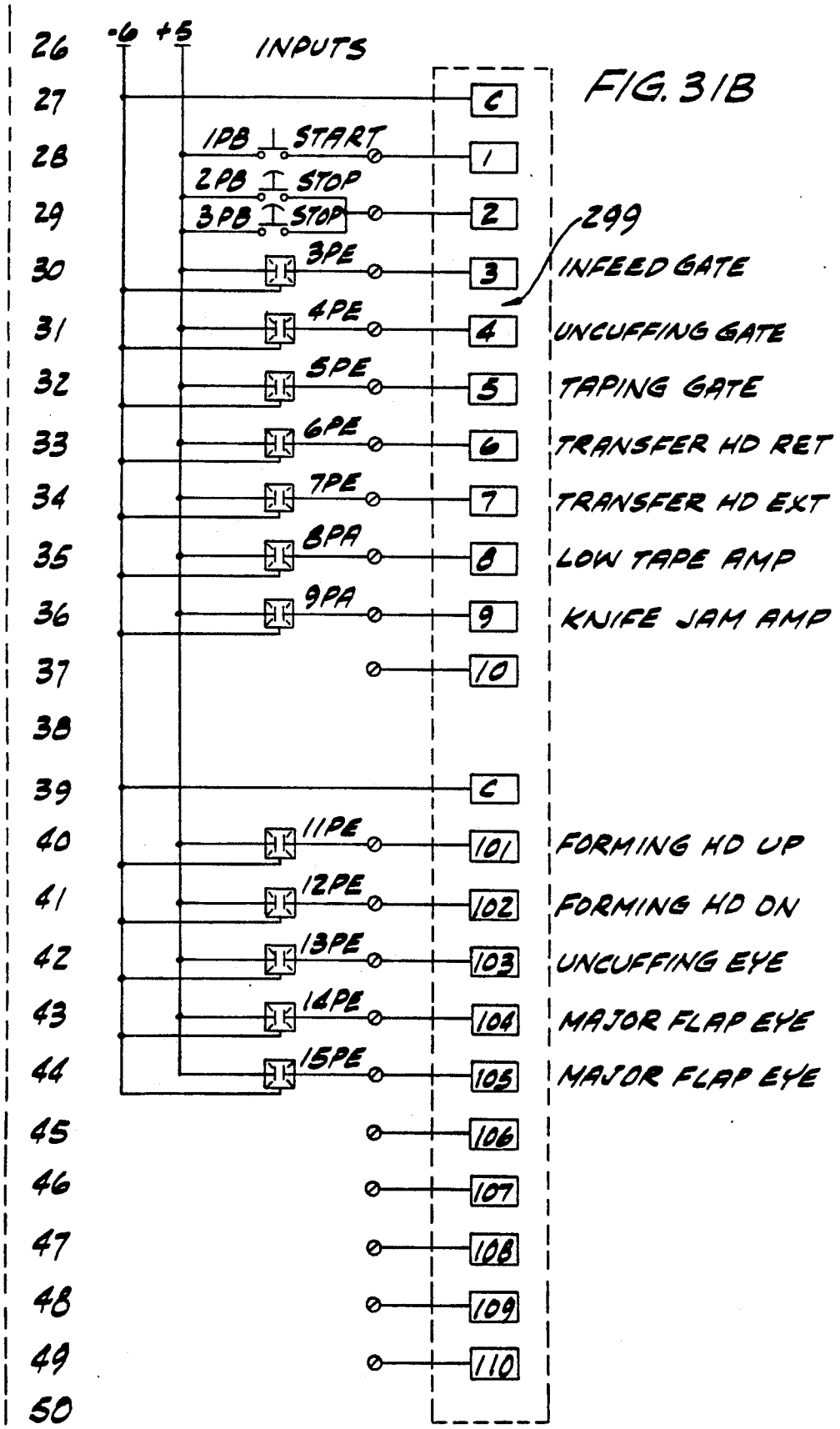
Figure 31C:
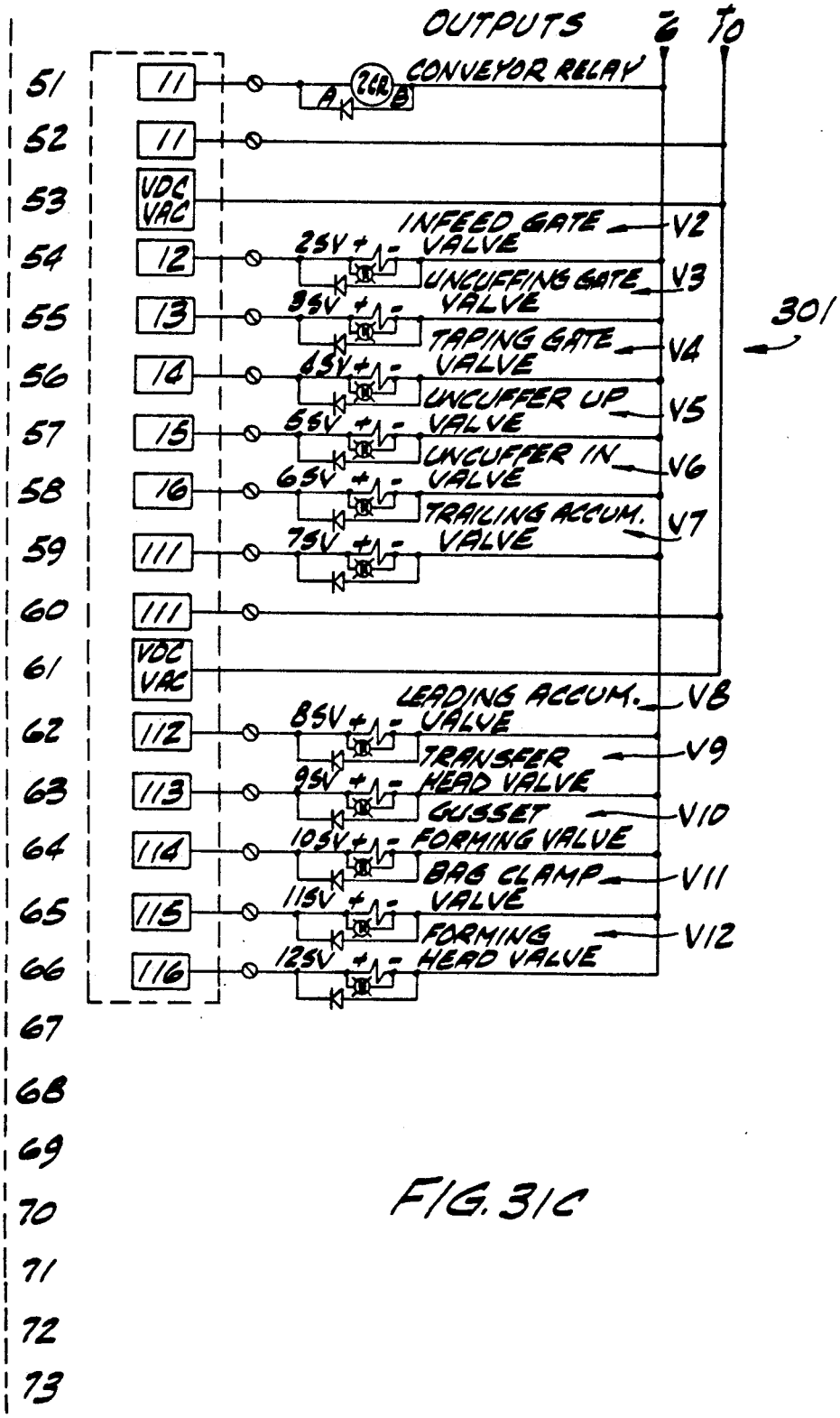

Referring to FIGS. 30A and B, the air cylinders and air-operated rotary actuators C2–12 are shown to be interconnected with a supply 285 of compressed air under control of solenoid valves V2–V12, respectively. At V1 is indicated a main solenoid valve for controlling the air supply. The operation of the valves for operation of the cylinders is under control of a programmable logic controller 287, such as an SLC150 programmable logic controller supplied by Allen-Bradley Company, Inc. of Milwaukee, Wis. (see FIG. 31A). Power supply circuitry for the controller and the conveyor motor M is indicated at 289 in FIG. 31A. Circuitry including a start switch 291, a stop switch, door switches or doors of a housing (not shown) for the apparatus, a master control relay 293, a main air valve 295 etc. is indicated at 297. Circuitry indicated at 299 in FIG. 31B includes photo-electric sensors 3PE–15PE for sensing various conditions as indicated in FIG. 31B, e.g. 6PE senses that the carriage 181 carrying the head 187 has returned to its retracted position and 7PE senses that it has been advanced to its extended position. These sensors act to cut off operation if there is a fault in the operation, e.g. the carriage 181 fails to return to its retracted position. Circuitry indicated at 301 in FIG. 31C includes the solenoid valves V2–V12.

In a cycle of operation of the apparatus, with the conveyor 25 running continuously, cases 5 with the filled bags 3 therein and with the tops of the bags cuffed down as indicated at 23 on the outside of the upright closure flaps 15 and 19 of the cases are fed to the infeed (right) end of the conveyor 25, the leading case engaging the stop 55. Under the control of the controller 287, cylinder C2 is actuated to push the leading case transversely from behind the stop 55. The four sets of uncuffing fingers 29 are in their swung-out retracted position of FIG. 18 at this time to clear the way for the case to move into position at the uncuffing station. They are also in their lowered position. The case travels on the upper reach 25*a* of the conveyor 25 to the point where it is arrested by the uncuffing station gates 61 at the uncuffing station S1 (see FIG. 19). As the case moves into position at this station, its leading end encounters the side flap fold-down arms 167 and swings them horizontally forward (see FIG. 19). With the case 5 parked at the uncuffing station, cylinders C6 are actuated to swing in the arms 133 carrying the four sets of fingers and the tips 31*t* and 33*t* of the fingers 31 and 33 come into engagement with the ends and sides of the case 5 at the uncuffing station below the lower edge of the cuff 23. Then cylinder C5 is actuated to raise the two lifts 87 at opposite sides of the conveyor 25 and thereby move the four sets 29 of fingers 31, 33 up to uncuff the bag (see FIGS. 2 and 3) by reason of the fingertips 31*t*, 33*t* moving up under the cuff. The top of the bag is thus caused to extend upward above the closure flaps 15 and 19 and to have the aforesaid side portions 23*c* extending up at the sides of the case and portions 23*a*, 23*b* at the leading and trailing ends 13 of the case, with the bag mouth open. Having completed the uncuffing of the bag, the cylinders C6 are actuated to swing the four sets of uncuffing fingers back outwardly to their retracted position of FIG. 18, and cylinder C5 is actuated to lower the lifts 87 and thus bring the uncuffing fingers 31, 33 back down to their lowered retracted position (their home position). When the lifts 87 are raised, the arms 167 are raised along with the lifts above the upper edges of the case flaps 15 and 19, and swing back to their retracted position of FIG. 18, and then when they come down with the lifts, they swing out the major flaps 15 (the side flaps) of the case (see FIG. 4).

Cylinder C12 is then actuated to lower the forming head 187 to the position wherein the intucking blades 195 are on the outside of the portions 23*a*, 23*b* of the upwardly extending bag top, and wherein the bag clamps 39 are on the outside of the side portions 23*c* of the bag top. Rotary actuator C10 is actuated to move the intucking blades 195 in for intucking and the rotary actuators C11 are actuated to swing the bag clamps in so that the bag clamp bars 217 engage the opposite sides of the bag top and flatten it as indicated at 43 in FIGS. 5 and 6, with the gussets 41 between the two opposite side portions of the bag top.

Cylinders C3 are then actuated to release the case 5 from the uncuffing station S1 and the case is conveyed forward on the top reach 25*a* of the conveyor 25 to the point where it is arrested at the station S2 by engagement of its forward end with gate 223. Cylinder C9 is actuated at the same time to move the carriage 181 carrying the head 187 (which is down) forward. The flattened top 43 of the bag is guided into the slot 229 between the beams 225 and 227, moves endwise in the slot to the point where its leading end engages the bag top stop 247. The case and bag continue to move forward after the leading end of the flattened bag top 43 engages the stop 247 until the case is arrested by the gate 223 at station S2. As the case and bag so continue their forward movement, the flattened bag top 43, being confined at its sides in the slot 229 between the beams, starts being gathered or crumpled for the formation of the neck N. The bag clamp bars 217 hold the flattened bag top up, and pass over the beams 225, 227. The leading and trailing minor flaps 19 are folded down rearward by the plows 235 (see FIG. 8).

Figure 22:
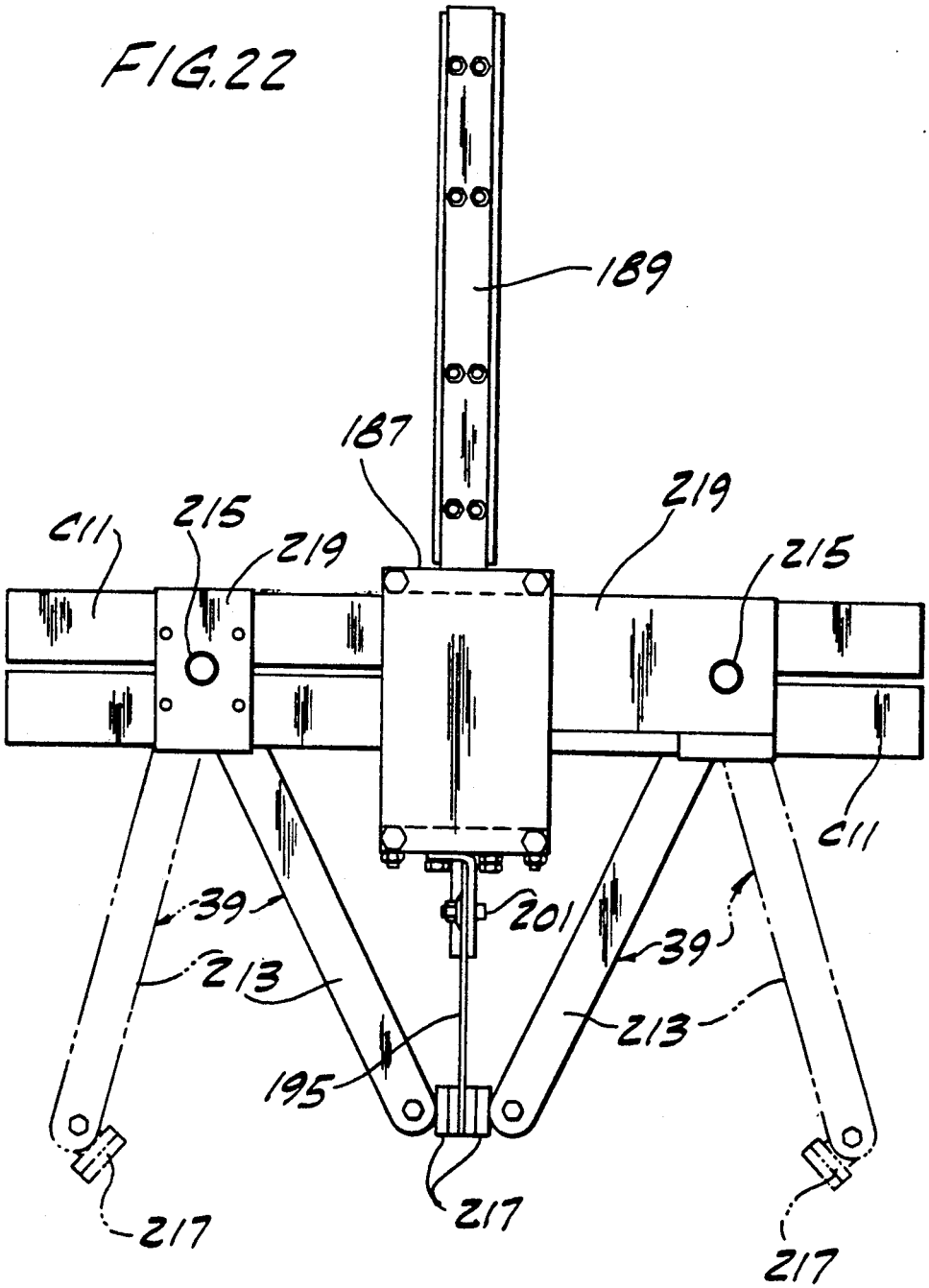
FIG. 22 is an end elevation of FIG. 20.

With the case 5 so transferred to the taping means 45, the rotary actuators C11 are actuated to release the bag clamps 39 from the bag top (these clamps being swung out to their FIG. 22 phantom position). Cylinder C12 is actuated to raise the head 187, pulling the intucking blades 195 up out of the bag top. Rotary actuator C10 is actuated to retract the blades 195, i.e. move them away from one another to their retracted position shown in solid lines in FIG. 21, and cylinder C9 is actuated to move the carriage 181 and the head 187 back to their retracted (home) position at the uncuffing station.

Cylinder C7 is actuated to move the accumulator or pusher fingers 249 forward from their home position of FIG. 24. In the initial phase of their forward travel, the fingers 249 are extended across the slot 229 by cam action and then move forward in the slot one adjacent the top and the other adjacent the bottom of the beams 225, 227. As they move forward, they engage the trailing (rearward) end of the flattened bag top and crumple it up against the fixed stop finger 247 to form the neck N as shown in FIGS. 27 and 28. When the neck has been compacted as illustrated in FIG. 28, cylinder C4 is actuated to open the gate 223 to release the case 5. The case is then transported forward by and on the upper reach 25*a* of the conveyor, and cylinder C8 is actuated to move the stop finger 247 forward generally in unison with the forward-moving accumulator fingers, the neck remaining compacted between finger 247 and fingers 249. This carries the compacted neck N through the tape applying means 237 which functions to wrap a length of pressure-sensitive adhesive tape around the neck in essentially the same manner as shown in the aforesaid U.S. Pat. Nos. 4,813,207 and 4,912,913, tile application of tile tape taking place between the upper and lower accumulator fingers 249 and above the finger 247. As the finger 247 reaches its extended position (FIG. 25) it is retracted into the beam 225 to clear the way for exit of the taped neck from the forward (downstream) end of the slot 229. Cylinders C7 and C8 are then actuated to return the fingers 247 and 249 to their home position of FIG. 24 ready for the taping of the neck of the next bag.

It will be observed that the apparatus is operable on non-square cases 5, as well as square cases, the compacting of the neck taking place against the stop finger 247 instead of against the edge of the leading minor closure flap. In this regard, it may be noted that in non-square rectangular cases, the minor flaps when folded down do not reach Lo the center of the case, and this is compensated or by having the stop finger 247 directly above the center of the position of the case at station S2 so that the neck is formed centrally of the bag 3 in the case. Further, the apparatus is capable of handling cases of different sizes by reason of the longitudinal adjustability of the uncuffing gates 61 and the gate 223, and the lateral and longitudinal adjustability of the sets 29 of uncuffing fingers 31 and 33.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. Apparatus for closing the top of a bag containing product in a rectangular case having two opposite sides and two opposite ends and side closure flaps and end closure flaps hinged to the top of the sides and ends, respectively, the flaps extending up at the sides and ends, the top of the bag being turned down inside out on the outside of the flaps forming a cuff, the apparatus comprising:

means for conveying cases with the bags therein endwise in a predetermined path one after another to an uncuffing station and holding each case at said station in a first position;

means at said uncuffing station for uncuffing the bag and causing the top of the bag to extend upward above the closure flaps with the top having portions extending up at the sides of the case and portions extending up at the ends of the case, and with the bag mouth open;

means at said uncuffing station for bringing the side portions of the top together to flatten the top generally in a vertical plane lying generally centrally between the sides of the case;

the conveyor then being operable to convey the case farther along said path to a second position farther along said path, the flattened top portion moving forward endwise generally in said plane, the case being held in said second position;

means for compacting said flattened top portion endwise to form it into a neck for the bag; and means for applying a closure to the neck to hold it closed;

wherein said means for flattening the bag top is moveable up and down at said uncuffing station between a raised retracted position above the top of the bag at said uncuffing station and a lowered position for effecting the flattening operation and also moveable in a path above the conveyor means parallel to the path of the cases away from a retracted position above the uncuffing station to an advanced position above the uncuffing station to an advanced position along said path downstream from said uncuffing station, said apparatus further having stop means movable transversely with respect to said path between a retracted position clear of said path at one side of said path and a stop position extending across said path for engagement of the leading end of said flattened bag top for holding the leading end of the top against forward movement, said stop means also being movable along said path from a rearward position relative to said path and a forward position relative to said path, pusher means movable transversely with respect to said path between a retracted position clear of said path and a pushing position extending across said path for engagement with the trailing end of said top, said pusher means also being movable when in its said pushing position along said path from a rearward position relative to said path and a forward position relative to said path;

means for moving the stop means transversely to said path to its stop position with the stop means in its said rearward position, then moving the stop means forward along said path while in its stop position, then moving said stop means transversely to said path out of said path for retracting the stop means after it reaches its said forward position, and then moving said stop means back with respect to said path for returning said stop means to its rearward position;

means for moving the pusher means transversely to said path to its pushing position extending across said path behind the trailing end of said bag top with the pusher means at its rearward position, and then moving the pusher means forward along said path while in its pushing position to gather said top against said stop means in its rearward position to form said top into a neck for the bag, then moving the pusher means forward simultaneously with the stop means following the gathering of the top into the neck between the pusher means and the stop means, then moving the pusher means transversely to said path and out of said path to its retracted position after it reaches its forward position and then moving the pusher means back with respect to said path for returning it to its rearward position;

and means for applying a closure to the compacted neck while it moves forward with the stop and pusher means from the rearward position of the stop means and while it is held compacted between the stop and pusher means.

2. Apparatus as set forth in claim 1 having means at the uncuffing station for intucking the end portions of the top to form gussets at the ends of the flattened top lying between the brought-together side portions of the top, and wherein the stop means, when interposed in said path, is generally directly above the position of the center of the case when the case is in its said second position.

3. Apparatus as set forth in claim 2 wherein the intucking means comprises a pair of intucking members movable toward and away from one another in said vertical plane, being movable toward one another for intucking said end portions.

4. Apparatus as set forth in claim 1 wherein the means for bringing the side portions of the top together comprises a pair of bag top clamp members movable inwardly against said side portions from both sides of the top.

5. Apparatus as set forth in claim 1 having means for folding down the side closure flaps of the case to extend outwardly from the case after the bag has been uncuffed.

6. Apparatus as set forth in claim 1 wherein the uncuffing means comprises forward and rearward uncuffer finger means at each side of the conveyor means at the uncuffing station, lift means mounting the forward and rearward finger means at each side of the conveyor means for movement upward from and movement back down to a lowered retracted position, and means mounting each finger means on the lift means for movement from a laterally retracted position to a position of engagement with a case below the lower edge of the cuff of the bag adjacent a respective vertical corner of the case at the uncuffing station for engagement of the finger means under the cuff upon raising of the lift means for the uncuffing of the bag.

7. Apparatus as set forth in claim 6 wherein each finger means comprises a first finger engageable with an end of the case and a second finger engageable with a side of the case at the uncuffing station.

8. Apparatus as set forth in claim 7 wherein the means mounting each finger means on each lift comprises an arm swingable in and out on said lift means, each finger means being swingable in and out with the respective arm.

9. Apparatus as set forth in claim 6 having a lift means at one side and a lift means at the other side of the conveyor and means mounting each lift means for adjustment transversely of the apparatus for handling cases of different widths.

10. Apparatus as set forth in claim 1 having a carriage movable between a retracted rearward position above the case at the uncuffing station and an advanced forward position, a head carried by the carriage movable up and down relative to the carriage, said bag top flattening means being carried by said head.

11. Apparatus for closing the top of a bag containing product in a rectangular case having two opposite sides and two opposite ends and side closure flaps and end closure flaps hinged to the top of the sides and ends, respectively, the flaps extending up at the sides and ends, the top of the bag being turned down inside out on the outside of the flaps forming a cuff, the apparatus comprising:

a conveyor for conveying cases with bags therein endwise in a horizontal path;

means for arresting each case and holding it for uncuffing of the bag therein at an uncuffing station;

means at said uncuffing station for uncuffing the bag and causing the top of the bag to extend upward above the closure flaps with the top having portions extending up at the sides of the case and portions extending up at the ends of the case, and with the bag mouth open;

a carriage movable in a horizontal path above and parallel to the path of cases on the conveyor between a retracted position above the uncuffing station and a forward position downstream from the uncuffing station;

means movable with the carriage and movable up and down relative to the carriage operable when back in retracted position with the carriage and in down position relative to the carriage for flattening the top of the bag generally in a vertical plane lying generally centrally between the sides of the case;

means for moving the carriage from its retracted position to its forward position and back to retracted position;

means carried by the carriage for moving the flattening means up and down relative to the carriage between a raised retracted position and said down position;

stop means movable transversely with respect to said path between a retracted position clear of said path at one side of said path and a stop position extending across said path for engagement of the leading end of said flattened bag top for holding the leading end of the top against forward movement;

said stop means also being movable along said path from a rearward position relative to said path and a forward position relative to said path;

pusher means movable transversely with respect to said path between a retracted position clear of said path and a pushing position extending across said path for engagement with the trailing end of said top;

said pusher means also being movable when in its said pushing position along said path from a rearward position relative to said path and a forward position relative to said path;

means for moving the stop means transversely to said path to its stop position with the stop means in its said rearward position, then moving the stop means forward along said path while in its stop position, then moving said stop means transversely to said path out of said path for retracting the stop means after it reaches its said forward position, and then moving said stop means back with respect to said path for returning and stop means to its rearward position;

means for moving the pusher means transversely to said path to its pushing position extending across said path behind the trailing end of said bag top with the pusher means at its rearward position, and moving the pusher means forward along said path while in its pushing position to gather said top against said stop means in its rearward position to form said top into a neck for the bag, moving the pusher means forward simultaneously with the stop means following the gathering of the top into the neck between the pusher means and the stop means, moving the pusher means transversely to said path and out of said path to its retracted position after it reaches its forward position and returning it to its rearward position; and means for applying a closure to the compacted neck while it moves forward with the stop and pusher means from the rearward position of the stop means and while it is held compacted between the stop and pusher means.

12. Apparatus as set forth in claim 11 wherein said flattening means comprises a pair of intucking members carried by the carriage for said movement therewith and for said movement up and down relative thereto, said apparatus having means on the carriage for moving said intucking members toward and away from one another in said vertical plane, said intucking members when away from one another being movable down on the outside of the end portions of the bag top and, when down, being movable toward one another for intucking said ends of the top, and bag top clamp members carried by the carriage for said movement therewith and for said movement up and down relative thereto and means carried by the carriage for moving said bag top clamp members inwardly when down for flattening the bag top.

13. Apparatus for closing the top of a bag containing product in a rectangular case having two opposite sides and two opposite ends and side closure flaps and end closure flaps hinged to the top of the sides and ends, respectively, the flaps extending up at the sides and ends, the top of the bag being turned down inside out on the outside of the flaps forming a cuff, the apparatus comprising:

a conveyor for conveying cases with bags therein endwise in a horizontal path;

means for arresting each case and holding it for uncuffing of the bag therein at an uncuffing station;

means at said uncuffing station for uncuffing the bag and causing the top of the bag to extend upward above the closure flaps with the top having portions extending up at the sides of the case and portions extending up at the ends of the case, and with the bag mouth open;

said uncuffing means comprising forward and rearward uncuffer finger means at each side of the conveyor at the uncuffing station, lift means mounting the forward and rearward finger means at each side of the conveyor for movement upward from and movement back down to a lowered retracted position, and means mounting each finger means on the lift means for movement in a plane parallel to the horizontal path from a laterally retracted position to a position of engagement with a case below the lower edge of the cuff of the bag adjacent a respective vertical corner of the case at the uncuffing station for engagement of the finger means under the cuff upon raising of the lift means for the uncuffing of the bag;

a carriage movable in a horizontal path above and parallel to the path of cases on the conveyor between a retracted position above the uncuffing station and a forward position downstream from the uncuffing station;

means movable with the carriage and movable up and down relative to the carriage operable when back in retracted position with the carriage and in down position relative to the carriage for flattening the top of the bag generally in a vertical plane lying generally centrally between the sides of the case;

means for moving the carriage from its retracted position to its forward position and back to retracted position;

means carried by the carriage for moving the flattening means up and down relative to the carriage between a raised retracted position and said down position;

said flattening means comprising a pair of intucking members carried by the carriage for said movement therewith and for said movement up and down relative thereto, said apparatus having means on the carriage for moving said intucking members toward and away from one another in said vertical plane, said intucking members when away from one another being movable down on the outside of the end portions of the bag top and, when down, being movable toward one another for intucking said ends of the top, and bag top clamp members carried by the carriage for said movement therewith and for said movement up and down relative thereto and means carried by the carriage for moving said bag top clamp members inwardly when down for flattening the bag top;

means for compacting the flattened top portion of the bag to form it into a neck for the bag; and means for applying a closure to the neck to held it closed.

14. Apparatus as set forth in claim 13 wherein each finger means comprises a first finger engageable with an end of the case and a second finger engageable with a side of the case at the uncuffing station and wherein the means mounting each finger means on each lift comprises an arm swingable in and out on said lift means, each finger means being swingable in and out with the respective arm;

said apparatus having a lift means at one side and a lift means at the other side of the conveyor and means mounting each lift for adjustment transversely of the apparatus for handling cases of different widths.

* * * * *